US007445543B2

(12) United States Patent
Torii et al.

(10) Patent No.: US 7,445,543 B2
(45) Date of Patent: Nov. 4, 2008

(54) POLISHING APPARATUS

(75) Inventors: Hiroomi Torii, Tokyo (JP); Takuji Hayama, Tokyo (JP); Tetsuya Yashima, Tokyo (JP)

(73) Assignee: Ebara Corporation, Tokyo (JP)

( * ) Notice: Subject to any disclaimer, the term of this patent is extended or adjusted under 35 U.S.C. 154(b) by 55 days.

(21) Appl. No.: 10/572,948

(22) PCT Filed: Oct. 14, 2004

(86) PCT No.: PCT/JP2004/015566

§ 371 (c)(1),
(2), (4) Date: Mar. 21, 2006

(87) PCT Pub. No.: WO2005/037488

PCT Pub. Date: Apr. 28, 2005

(65) Prior Publication Data

US 2006/0292967 A1 Dec. 28, 2006

(30) Foreign Application Priority Data

Oct. 17, 2003 (JP) ..... 2003-358593

(51) Int. Cl.
*B24B 29/00* (2006.01)

(52) U.S. Cl. ..... 451/289; 451/388; 451/398

(58) Field of Classification Search ..... 451/285–289, 451/41, 388, 397, 398; 438/691–693
See application file for complete search history.

(56) References Cited

U.S. PATENT DOCUMENTS 5,738,574 A * 4/1998 Tolles et al. ..... 451/288
6,080,046 A 6/2000 Shendon et al.
6,086,457 A 7/2000 Perlov et al.
6,102,057 A 8/2000 Vogtmann et al.
6,126,517 A 10/2000 Tolles et al.
6,131,589 A 10/2000 Vogtmann et al.
6,267,642 B1 7/2001 Vogtmann et al.
6,283,827 B1 9/2001 Vogtmann et al.
6,325,698 B1 12/2001 Wada et al.
6,354,922 B1 3/2002 Sakurai et al.
6,358,128 B1 3/2002 Sakurai et al.
6,405,740 B1 6/2002 Vogtmann et al.
6,505,635 B1 1/2003 Vogtmann et al.
6,796,881 B1 9/2004 Vogtmann et al.
7,044,832 B2 5/2006 Yilmaz et al.
7,063,598 B2 * 6/2006 Isobe et al. ..... 451/54
2001/0055937 A1 12/2001 Wada et al.

(Continued)

FOREIGN PATENT DOCUMENTS

EP 0 774 323 A2 5/1997

(Continued)

*Primary Examiner*—Dung Van Nguyen
(74) *Attorney, Agent, or Firm*—Wenderoth, Lind & Ponack, L.L.P.

(57) ABSTRACT

A polishing apparatus has a top ring configured to hold a semiconductor wafer on a substrate holding surface, and a pushser configured to deliver the semiconductor wafer to the top ring and receive the semiconductor wafer from the top ring. The pushser includes a push stage having a substrate placement surface on which the semiconductor wafer is placed and an air cylinder configured to vertically move the push stage. The pushser also includes a high-pressure fluid port configured to eject a high-pressure fluid toward the semiconductor wafer.

21 Claims, 19 Drawing Sheets

U.S. PATENT DOCUMENTS

| | | | |
|---|---|---|---|
| 2002/0045410 | A1 | 4/2002 | Sakurai et al. |
| 2003/0211812 | A1 | 11/2003 | Isobe et al. |
| 2004/0137823 | A1 | 7/2004 | Sakurai et al. |
| 2004/0221874 | A1 | 11/2004 | Wada et al. |

FOREIGN PATENT DOCUMENTS

| | | |
|---|---|---|
| EP | 1 034 887 A2 | 9/2000 |
| JP | 8-229807 | 9/1996 |
| WO | 99/41022 | 8/1999 |

* cited by examiner 1
3
105
133
144
149
150
W
137
146
131
140
141
142
147
160
148
132
152
134
153
135
154
155
136
156

1
W
130
200
137
133
132
160
4
105

1
4
105
130
131
132
133
137
160
210
211
212
V13
W

POLISHING APPARATUS

TECHNICAL FIELD

The present invention relates to a polishing apparatus for polishing a substrate such as a semiconductor wafer to a flat mirror finish, and more particularly to a polishing apparatus having a substrate relay device for transferring a substrate between a substrate holding device, such as a top ring or a carrier head, and a transfer device such a robot or a transporter.

BACKGROUND ART

In recent years, semiconductor devices have become more integrated, and structures of semiconductor elements have become more complicated. Further, a number of layers in multilayer interconnects used for a logical system has been increased. Accordingly, irregularities on a surface of a semiconductor device are increased, so that step heights on the surface of the semiconductor device tend to be large. This is because, in a manufacturing process of a semiconductor device, a thin film is formed on a semiconductor device, then micromachining processes, such as patterning or forming holes, are performed on the semiconductor device, and these processes are repeated to form subsequent thin films on the semiconductor device.

When a number of irregularities is increased on a surface of a semiconductor device, the following problems arise. When a thin film is formed on a semiconductor device, a thickness of the film formed at portions having a step is relatively small. Further, an open circuit may be caused by disconnection of interconnects, or a short circuit may be caused by insufficient insulation between interconnect layers. As a result, good products cannot be obtained, and a yield tends to be lowered. Further, even if a semiconductor device initially works normally, reliability of the semiconductor device is lowered after a long-term use. At a time of exposure in a lithography process, if an irradiation surface has irregularities, then a lens unit in an exposure system is locally unfocused. Therefore, if the irregularities of the surface of the semiconductor device are increased, then it becomes problematically difficult to form a fine pattern itself on the semiconductor device.

Thus, in a manufacturing process of a semiconductor device, it becomes increasingly important to planarize a surface of the semiconductor device. The most important one of planarizing technologies is chemical mechanical polishing (CMP). In a polishing apparatus for chemical mechanical polishing, while a polishing liquid containing abrasive particles such as silica ($SiO_2$) therein is supplied onto a polishing surface such as a polishing pad, a substrate such as a semiconductor wafer is brought into sliding contact with the polishing surface, so that the substrate is polished.

This type of polishing apparatus includes a polishing table having a polishing surface formed by a polishing pad, and a substrate holding device, which is referred to as a top ring or a carrier head, for holding a substrate such as a semiconductor wafer. When a semiconductor wafer is polished with such a polishing apparatus, the semiconductor wafer is held and pressed against the polishing surface under a predetermined pressure by the substrate holding device. At that time, the polishing table and the substrate holding device are moved relative to each other to bring the semiconductor wafer into sliding contact with the polishing surface, so that a surface of the semiconductor wafer is polished to a flat mirror finish.

In such a polishing apparatus, if a relative pressing force between the semiconductor wafer being polished and the polishing surface of the polishing pad is not uniform over an entire surface of the semiconductor wafer, then the semiconductor wafer may be insufficiently polished or may be excessively polished at some portions depending on a pressing force applied to those portions of the semiconductor wafer. Therefore, it has been attempted to form a surface, for holding a semiconductor wafer, of a substrate holding device from a membrane made of an elastic material such as rubber and to supply fluid pressure such as air pressure to a backside surface of the membrane to uniformize pressing forces applied to the semiconductor wafer over an entire surface of the semiconductor wafer.

If a transfer device such as a robot is used to directly deliver a semiconductor wafer to be polished to the substrate holding device and directly receive a polished semiconductor wafer from the substrate holding device, then the transfer device may fail in this transfer because of a difference of transferring precision between the transfer device and the substrate holding device. Accordingly, the polishing apparatus may include a substrate relay device disposed at a delivery position of a semiconductor wafer to the substrate holding device or at a receiving position of a semiconductor wafer from the substrate holding device. Such a substrate relay device is referred to as a pusher. A semiconductor wafer transferred by a transfer device such as a robot is placed on the substrate relay device. Then, the substrate relay device lifts the semiconductor wafer to the substrate holding device such as a top ring, which has been moved above the substrate relay device, and delivers the semiconductor wafer to the substrate holding device. Further, the substrate relay device receives the semiconductor wafer from the substrate holding device and delivers the semiconductor wafer to the transfer device.

When a substrate such as a semiconductor wafer is transferred from a substrate holding device such as a top ring to a pusher (substrate relay device), a pressurized fluid (a gas, a liquid, or a mixture of a gas and a liquid) is introduced into a fluid passage provided in the top ring to eject and remove the semiconductor wafer from the top ring. At that time, since a gap is formed between the top ring and the pusher, the semiconductor wafer falls down through the gap after it is separated from the top ring. The pusher catches and receives this fallen semiconductor wafer.

In the aforementioned polishing apparatus, a semiconductor wafer is polished under various polishing conditions including a type of slurry (polishing liquid), polishing time, pressing forces of the semiconductor wafer, and rotational speeds of a top ring and a polishing table. Under some polishing conditions, a polished semiconductor wafer may firmly adhere to the top ring when the semiconductor wafer is to be separated from the top ring. In such a case, the semiconductor wafer cannot be removed from the top ring. Particularly, when a surface, for holding a semiconductor wafer, of a substrate holding device is formed by a membrane, and a fluid pressure such as air pressure is supplied to a backside surface of the membrane to press the semiconductor wafer against the polishing surface on the polishing table, the following problems may arise because the membrane is made of rubber. When the semiconductor wafer is to be separated from the substrate holding device after polishing, the semiconductor wafer adheres to the membrane so that it cannot be removed from the substrate holding device. Otherwise, it takes much time to separate the semiconductor wafer from the substrate holding device. Further, the semiconductor wafer may fall down in an oblique state while a portion of the semiconductor wafer adheres to the membrane. In such cases, if a pressure of fluid ejected from the top ring is increased in order to reliably remove the semiconductor wafer from the top ring, then the semiconductor wafer falls down toward the pusher with force, thereby causing damage or breakage of the semiconductor wafer.

In recent years, low-k materials having a low dielectric constant have been developed as interlayer dielectrics instead of $SiO_2$. However, such low-k materials have a low mechanical strength and are thus likely to be broken. Accordingly, if a semiconductor wafer employing such a low-k material is to be removed from the top ring by ejection of a pressurized fluid, the low-k material in the semiconductor wafer is broken by impact of falling, so that a yield is lowered.

SUMMARY OF THE INVENTION

The present invention has been made in view of the above drawbacks. It is therefore an object of the present invention to provide a polishing apparatus which can quickly and reliably separate a substrate, such as a semiconductor wafer, from a substrate holding device such as a top ring after polishing, can safely remove the substrate from the substrate holding device without an excessive force being applied to the substrate, and can have no impact upon the substrate when the substrate is transferred from the substrate holding device to a substrate relay device.

According to a first aspect of the present invention, there is provided a polishing apparatus having a substrate holding device, such as a top ring, configured to hold a substrate on a substrate holding surface, and a substrate relay device, such as a pusher, configured to deliver the substrate to the substrate holding device and receive the substrate from the substrate holding device. The substrate relay device includes a substrate placement section having a substrate placement surface on which the substrate is placed, and a moving mechanism configured to vertically move the substrate placement section. The substrate relay device also includes a high-pressure fluid port configured to eject a high-pressure fluid toward the substrate.

When a substrate is transferred from the substrate holding device to the substrate relay device, a high-pressure fluid is ejected from the high-pressure fluid port between the substrate holding surface of the substrate holding device and the substrate. Thus, the substrate can be removed from the substrate holding device by pressure of the high-pressure fluid.

The high-pressure fluid port may be configured to eject the high-pressure fluid between the substrate holding surface of the substrate holding device and the substrate to separate the substrate from the substrate holding surface of the substrate holding device. The substrate relay device may include a cover provided around the high-pressure fluid port to prevent the high-pressure fluid from scattering around the high-pressure fluid port.

According to a second aspect of the present invention, there is provided a polishing apparatus having a substrate holding device, such as a top ring, configured to hold a substrate on a substrate holding surface, and a substrate relay device, such as a pusher, configured to deliver the substrate to the substrate holding device and receive the substrate from the substrate holding device. The substrate relay device includes a substrate placement section having a substrate placement surface on which the substrate is placed, and a moving mechanism configured to vertically move the substrate placement section. The substrate relay device also includes a fluid supply passage configured to supply a fluid onto the substrate placement surface of the substrate placement section so as to form a fluid film on the substrate placement surface of the substrate placement section.

When a substrate is transferred from the substrate holding device to the substrate relay device, the substrate is attracted by a fluid film (liquid film), which is formed on the substrate placement surface of the substrate placement section of the substrate relay device. Therefore, the substrate can reliably be removed from the substrate holding device by surface tension of the fluid film. Further, since the substrate is attracted by the fluid film, it is possible to prevent the substrate from falling down toward the substrate relay device with force due to ejection of a pressurized fluid when the substrate is released from the substrate holding device. Thus, the substrate is subjected to no impact.

The fluid supply passage may be configured to form the fluid film on the substrate placement surface of the substrate placement section so that the substrate is attracted to the substrate placement surface by the fluid film when the substrate is transferred between the substrate holding device and the substrate relay device. The fluid supply passage may be configured to supply the fluid onto the substrate placement surface of the substrate placement section to separate the substrate from the substrate placement surface after the substrate has been transferred from the substrate holding device to the substrate relay device.

According to a third aspect of the present invention, there is provided a polishing apparatus having a substrate holding device, such as a top ring, configured to hold a substrate on a substrate holding surface, and a substrate relay device, such as a pusher, configured to deliver the substrate to the substrate holding device and receive the substrate from the substrate holding device. The substrate relay device includes a substrate placement section having an attraction section on which the substrate is placed. The attraction section includes an elastic body defining a fluid chamber. The substrate relay device also includes a moving mechanism configured to vertically move the substrate placement section and a passage connecting the fluid chamber of the attraction section to a fluid supply source and/or a vacuum source.

When a substrate is transferred from the substrate holding device to the substrate relay device, the substrate is attracted to the attraction section of the substrate relay device. Therefore, the substrate can reliably be removed from the substrate holding device. Further, since the attraction section attracts the substrate, it is possible to prevent the substrate from falling down toward the substrate relay device with force due to ejection of a pressurized fluid when the substrate is released from the substrate holding device. Thus, the substrate is subjected to no impact.

The attraction section may include an attraction section body having a chamber surface. The fluid chamber may be defined by the chamber surface of the attraction section body and the elastic body. The attraction section body may have a recessed surface as the chamber surface. The attraction section may be operable to attract the substrate by evacuating the fluid chamber through the passage when the substrate is transferred between the substrate holding device and the substrate relay device. The attraction section may be operable to separate the substrate from the attraction section by supplying a fluid from the fluid supply source through the passage after the substrate has been transferred from the substrate holding device to the substrate relay device.

According to a fourth aspect of the present invention, there is provided a polishing apparatus having a substrate holding device, such as a top ring, configured to hold a substrate on a substrate holding surface, and a substrate relay device, such as a pusher, configured to deliver the substrate to the substrate holding device and receive the substrate from the substrate holding device. The substrate relay device includes a substrate placement section having a substrate placement surface on which the substrate is placed, and a moving mechanism configured to vertically move the substrate placement section. The substrate relay device also includes a chucking mechanism which is brought into contact with a peripheral portion of the substrate.

The chucking mechanism may include a link configured to be introduced between the substrate holding surface of the substrate holding device and the substrate. Alternatively, the chucking mechanism may include a link configured to hold a peripheral edge of the substrate.

When a substrate is transferred from the substrate holding device to the substrate relay device, a tip of the chucking mechanism is introduced between the substrate holding surface of the substrate holding device and the substrate, or a peripheral edge of the substrate is held by the chucking mechanism. Thus, the substrate can forcibly be separated from the substrate holding surface by the chucking mechanism.

According to a fifth aspect of the present invention, there is provided a polishing apparatus having a substrate holding device, such as a top ring, configured to hold a substrate on a substrate holding surface, and a substrate relay device, such as a pusher, configured to deliver the substrate to the substrate holding device and receive the substrate from the substrate holding device. The substrate relay device includes a substrate placement section having a substrate placement surface on which the substrate is placed, and a moving mechanism configured to vertically move the substrate placement section. The substrate relay device also includes a tub configured to immerse in a liquid the substrate placement section and the substrate held by the substrate holding device.

Thus, the substrate placement section and the substrate are immersed in a liquid stored in the tub. The liquid is introduced between the substrate and the substrate holding surface of the substrate holding device to release adherence of the substrate to the substrate holding device. Accordingly, the substrate can be separated from the substrate holding device. Further, since the liquid is present between the substrate placement section and the substrate when the substrate is separated from the substrate holding device, it is possible to prevent the substrate from falling down toward the substrate relay device with force due to ejection of a pressurized fluid.

The substrate holding device may have a passage configured to supply a pressurized fluid from the substrate holding surface to the substrate when the substrate is transferred from the substrate holding device to the substrate relay device. The substrate holding device may include an elastic pad having the substrate holding surface. The elastic pad may include an opening connected to a fluid supply source and/or a vacuum source. The substrate holding device may include a support member configured to support the elastic pad, and a substrate holding device body having a space to accommodate the elastic pad and the support member. The substrate holding device may further include an abutment member attached to the support member. The abutment member may have an elastic membrane brought into contact with the elastic pad. The substrate holding device may include a first pressure chamber defined between the substrate holding device body and the support member, a second pressure chamber defined outside of the abutment member between the elastic pad and the support member, and a third pressure chamber defined inside of the abutment member. The first pressure chamber, the second pressure chamber, and the third pressure chamber may be independently connected to the fluid supply source and/or the vacuum source.

According to the present invention, after a polishing process of a substrate such as a semiconductor wafer is completed, the substrate can quickly and reliably be separated from a substrate holding device. Further, the substrate can safely be removed from the substrate holding device without an excessive force being applied to the substrate. Furthermore, the substrate is subjected to no impact when it is transferred from the substrate holding device to a substrate relay device. Accordingly, the substrate is prevented from being damaged or broken. Thus, a yield can be improved. Further, since the substrate can quickly be removed from the substrate holding device, throughput can be improved. Furthermore, since impact is reduced when the substrate is transferred to the substrate relay device, a yield can be improved remarkably in a process employing a low-k material.

The above and other objects, features, and advantages of the present invention will be apparent from the following description when taken in conjunction with the accompanying drawings which illustrate preferred embodiments of the present invention by way of example.

DETAILED DESCRIPTION OF THE PREFERRED EMBODIMENTS

A polishing apparatus according to embodiments of the present invention will be described below with reference to FIGS. 1 through 19B.

Figure 1:
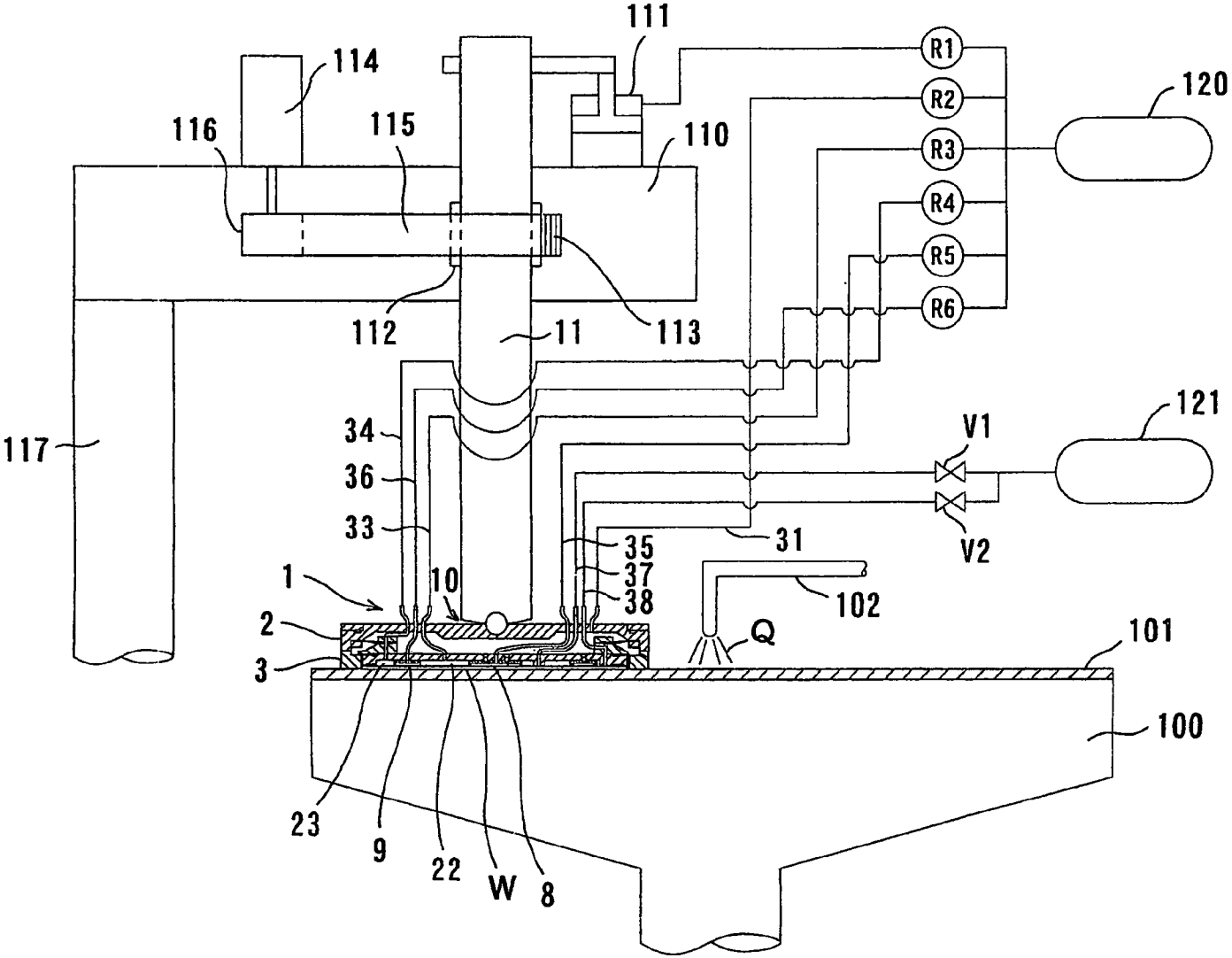
FIG. 1 is a schematic view showing an entire arrangement of a polishing apparatus according to an embodiment of the present invention.

FIG. 1 is a schematic view showing an entire arrangement of a polishing apparatus according to the present invention. As shown in FIG. 1, the polishing apparatus has a top ring 1 serving as a substrate holding device for holding a substrate such as a semiconductor wafer, and a polishing table 100 provided underneath the top ring 1. The polishing table 100 has a polishing pad 101 attached on an upper surface thereof. The polishing pad 101 serves as a polishing surface. The polishing apparatus includes a polishing liquid supply nozzle 102 provided above the polishing table 100 for supplying a polishing liquid Q onto the polishing pad 101.

Various kinds of polishing pads are available on the market. For example, some of these are SUBA800, IC-1000, and IC-1000/SUBA400 (two-layer layer cloth) manufactured by Rodel Inc., and Surfin xxx-5 and Surfin 000 manufactured by Fujimi Inc. SUBA800, Surfin xxx-5, and Surfin 000 are non-woven fabrics bonded by urethane resin, and IC-1000 is made of rigid foam polyurethane (single layer). Foam polyurethane is porous and has a large number of fine recesses or holes formed in its surface.

Although the polishing pad serves as the polishing surface, the polishing surface is not limited to the polishing pad. For example, the polishing surface may be constituted by a fixed abrasive. The fixed abrasive is formed into a flat plate comprising abrasive particles fixed by a binder. With the fixed abrasive for polishing, a polishing process is performed by abrasive particles that are self-generated from the fixed abrasive. The fixed abrasive comprises abrasive particles, a binder, and pores. For example, cerium dioxide ($CeO_2$), silicon oxide ($SiO_2$), or alumina ($Al_2O_3$) having an average particle diameter of at most 0.5 μm is used as abrasive particles, and thermosetting resin such as epoxy resin or urethane resin or thermoplastic resin such as MBS resin or ABS resin is used as a binder. Such a fixed abrasive forms a harder polishing surface. The fixed abrasive includes a fixed abrasive pad having a two-layer structure formed by a thin layer of a fixed abrasive and an elastic polishing pad attached to a lower surface of the thin layer of the fixed abrasive.

The top ring 1 is connected to a top ring drive shaft 11 by a universal joint 10, and the top ring drive shaft 11 is coupled to a top ring air cylinder 111 fixed to a top ring head 110. The top ring air cylinder 111 is actuated to move the top ring drive shaft 11 vertically to thereby lift and lower the top ring 1 as a whole and to press a retainer ring 3 fixed to a lower end of a top ring body 2 against the polishing pad 101. The top ring air cylinder 111 is connected to a compressed air source (fluid supply source) 120 via a regulator R1, which can regulate pressure of compressed air or the like which is supplied to the top ring air cylinder 111. Thus, it is possible to adjust a pressing force to press the polishing pad 101 with the retainer ring 3.

The top ring drive shaft 11 is connected to a rotary sleeve 112 by a key (not shown). The rotary sleeve 112 has a timing pulley 113 fixedly disposed at a peripheral portion thereof. A top ring motor 114 is fixed to the top ring head 110, and the timing pulley 113 is coupled to a timing pulley 116 mounted on the top ring motor 114 via a timing belt 115. Therefore, when the top ring motor 114 is energized for rotation, the rotary sleeve 112 and the top ring drive shaft 11 are rotated in unison with each other via the timing pulley 116, the timing belt 115, and the timing pulley 113 to thereby rotate the top ring 1. The top ring head 110 is supported on a top ring head shaft 117 fixedly supported on a frame (not shown). The top ring head shaft 117 is rotatable about its axis. When the top ring head shaft 117 is rotated, the top ring 1 is angularly moved between a polishing position on the polishing table 100 and a pusher, which is described later.

There will be described below the top ring 1 as the substrate holding device.

Figure 2:
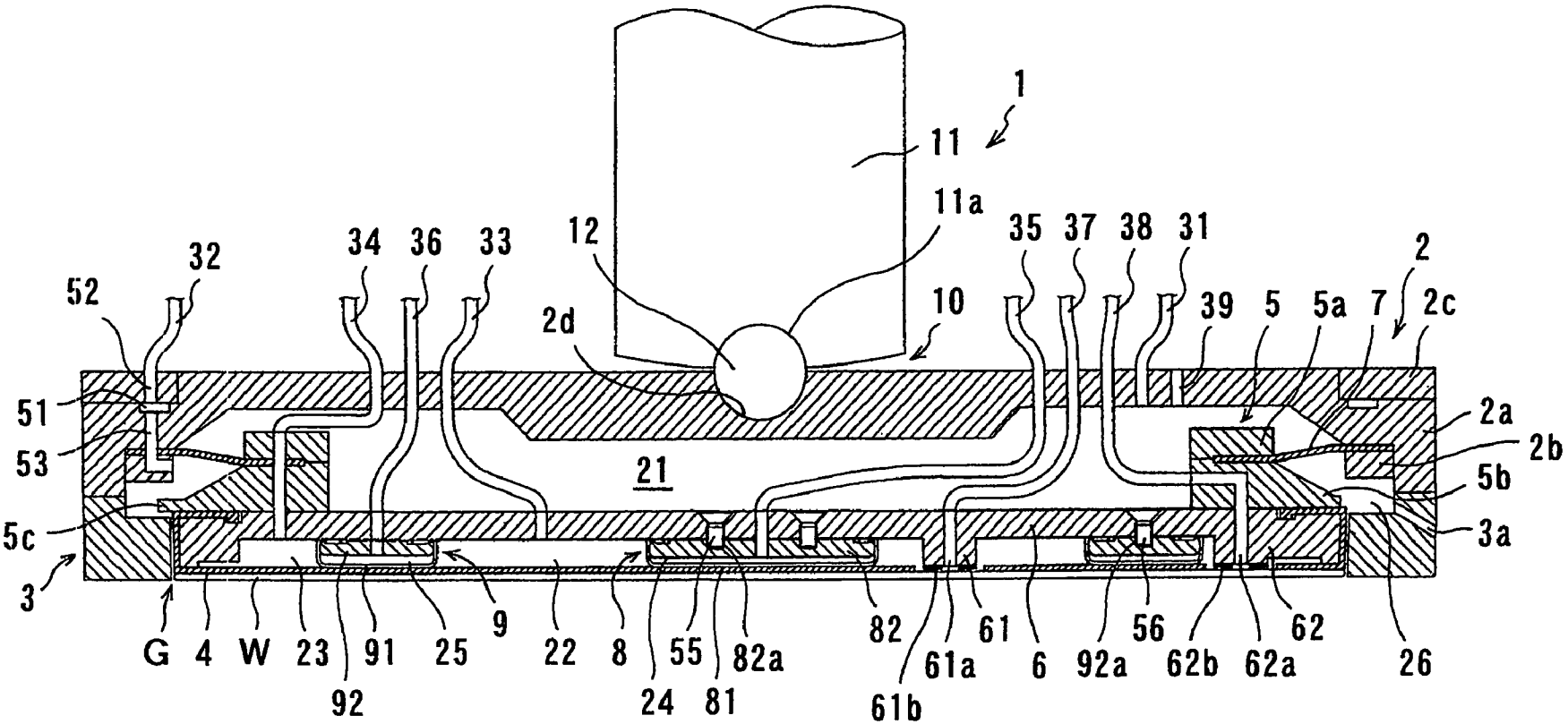
FIG. 2 is a vertical cross-sectional view of a top ring in the polishing apparatus shown in FIG. 1.
Figure 3:
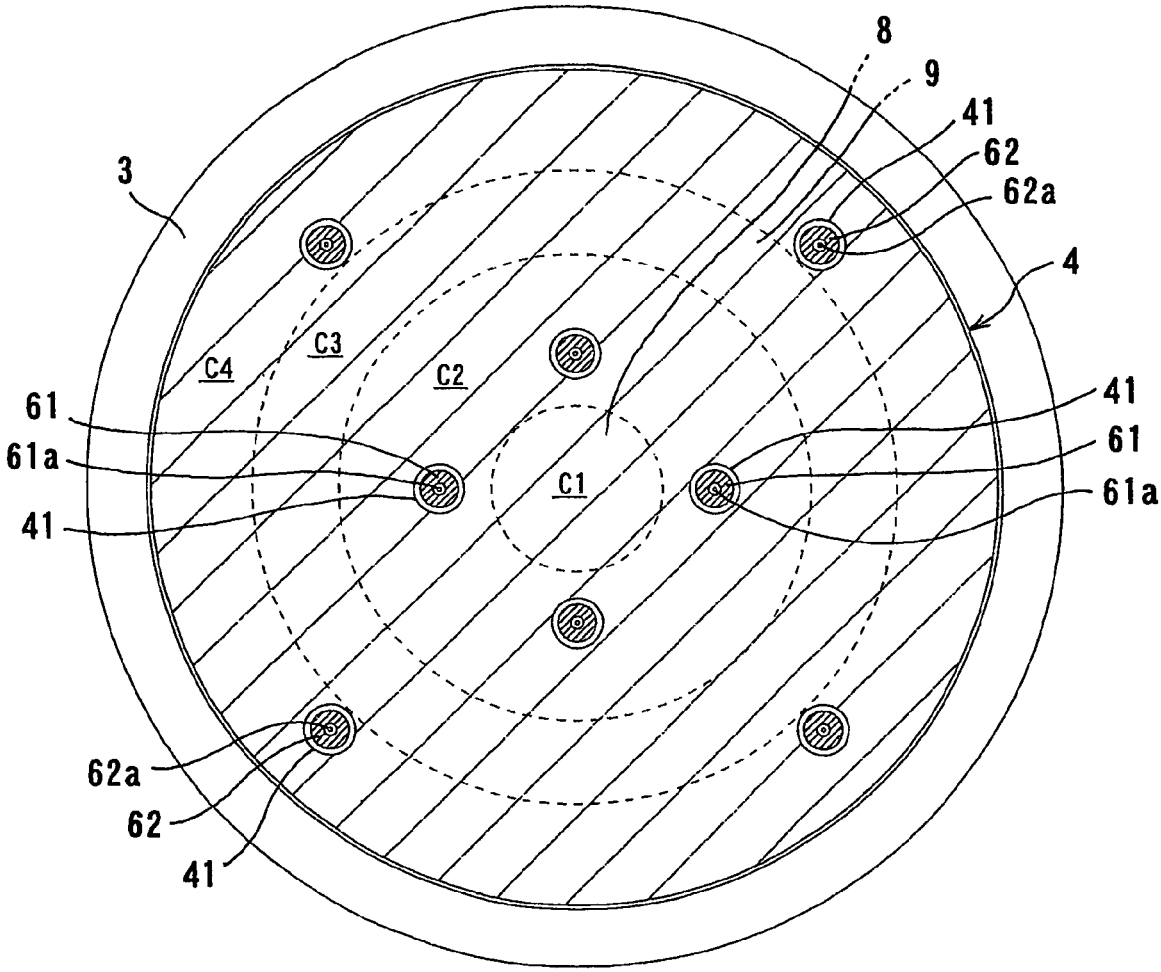
FIG. 3 is a bottom view of the top ring shown in FIG. 2.

FIG. 2 is a vertical cross-sectional view showing the top ring 1, and FIG. 3 is a bottom view of the top ring 1 shown in FIG. 2. As shown in FIG. 2, the top ring 1 as a substrate holding device has a top ring body 2 in the form of a cylindrical housing with a receiving space defined therein, and a retainer ring 3 fixed to a lower end of the top ring body 2. The top ring body 2 is made of a material having high strength and rigidity, such as metal or ceramic. The retainer ring 3 is made of highly rigid synthetic resin, ceramic, or the like.

The top ring body 2 includes a cylindrical housing 2*a*, an annular pressurizing sheet support 2*b* fitted into a cylindrical portion of the housing 2*a*, and an annular seal 2*c* fitted over an outer circumferential edge of an upper surface of the housing 2*a*. The retainer ring 3 is fixed to a lower end of the housing 2*a* of the top ring body 2. The retainer ring 3 has a lower portion projecting radially inward. The retainer ring 3 may be formed integrally with the top ring body 2.

The top ring drive shaft 11 is disposed above a central portion of the housing 2*a* of the top ring body 2, and the top ring body 2 is coupled to the top ring drive shaft 11 by the universal joint 10. The universal joint 10 has a spherical bearing mechanism by which the top ring body 2 and the top ring drive shaft 11 are tiltable with respect to each other, and a rotation transmitting mechanism for transmitting rotation of the top ring drive shaft 11 to the top ring body 2. The spherical bearing mechanism and the rotation transmitting mechanism transmit a pressing force and a rotating force from the top ring drive shaft 11 to the top ring body 2 while allowing the top ring body 2 and the top ring drive shaft 11 to be tilted with respect to each other.

The spherical bearing mechanism includes a hemispherical concave recess 11*a* defined centrally in a lower surface of the top ring drive shaft 11, a hemispherical concave recess 2*d* defined centrally in an upper surface of the housing 2*a*, and a bearing ball 12 made of a highly hard material such as ceramic and interposed between the concave recesses 11*a* and 2*d*. Meanwhile, the rotation transmitting mechanism includes drive pins (not shown) fixed to the top ring drive shaft 11, and driven pins (not shown) fixed to the housing 2*a*. Even if the top ring body 2 is tilted with respect to the top ring drive shaft 11, the drive pins and the driven pins remain in engagement with each other while contact points are displaced because the drive pins and the driven pins are vertically movable relative to each other. Thus, the rotation transmitting mechanism reliably transmits rotational torque of the top ring drive shaft 11 to the top ring body 2.

The top ring body 2 and the retainer ring 3 secured to the top ring body 2 have a space defined therein, which accommodates therein an elastic pad (membrane) 4 having a lower surface (substrate holding surface) brought into contact with a semiconductor wafer W held by the top ring 1, an annular holder ring 5, and a disk-shaped subcarrier plate 6 (support member) for supporting the elastic pad 4. The elastic pad 4 has a radially outer edge clamped between the holder ring 5 and the subcarrier plate 6 secured to a lower end of the holder ring 5 and extends radially inward so as to cover a lower surface of the subcarrier plate 6. Thus, a space is defined between the elastic pad 4 and the subcarrier plate 6.

The subcarrier plate 6 may be made of metal. However, when a thickness of a thin film formed on a surface of a semiconductor wafer is measured by a method using eddy current in a state such that a semiconductor wafer to be polished is held by the top ring, the subcarrier plate 6 should preferably be made of a non-magnetic material, e.g., an insulating material such as fluororesin or ceramic.

A pressurizing sheet 7 comprising an elastic membrane extends between the holder ring 5 and the top ring body 2. The pressurizing sheet 7 has a radially outer edge clamped between the housing 2*a* and the pressurizing sheet support 2*b* of the top ring body 2, and a radially inner edge clamped between an upper end portion 5*a* and a stopper 5*b* of the holder ring 5. The top ring body 2, the subcarrier plate 6, the holder ring 5, and the pressurizing sheet 7 jointly define a pressure chamber 21 (first pressure chamber) in the top ring body 2. A fluid passage 31 comprising tubes and connectors communicates with the pressure chamber 21, which is connected to the compressed air source 120 via a regulator R2 provided in the fluid passage 31 as shown in FIG. 1. The pressurizing sheet 7 is made of a highly strong and durable rubber material such as ethylene propylene rubber (EPDM), polyurethane rubber, or silicone rubber.

In a case where the pressurizing sheet 7 is made of an elastic material such as rubber, if the pressurizing sheet 7 is fixedly clamped between the retainer ring 3 and the top ring body 2, then a desired horizontal surface cannot be maintained on a lower surface of the retainer ring 3 because of elastic deformation of the pressurizing sheet 7 as an elastic material. In order to prevent such a drawback, the pressurizing sheet 7 is clamped between the housing 2*a* of the top ring body 2 and the pressurizing sheet support 2*b* provided as a separate member in the present embodiment. As disclosed by Japanese laid-open patent application Nos. 09-168964 and 2001-179605, the retainer ring 3 may be movable vertically with respect to the top ring body 2, or the retainer ring 3 may have a structure capable of pressing the polishing surface independently of the top ring body 2. In such cases, the pressurizing sheet 7 is not necessarily fixed in the aforementioned manner.

A cleaning liquid passage 51 in the form of an annular groove is defined in an upper surface of the housing 2*a* near its outer circumferential edge over which the seal 2*c* of the top ring body 2 is fitted. The cleaning liquid passage 51 communicates with a fluid passage 32 through a through-hole 52 formed in the seal 2*c*, and is supplied with a cleaning liquid (pure water) through the fluid passage 32. A plurality of communication holes 53 are defined in the housing 2*a* and the pressurizing sheet support 2*b* in communication with the cleaning liquid passage 51. The communication holes 53 communicate with a small gap G defined between an outer circumferential surface of the elastic pad 4 and an inner circumferential surface of the retainer ring 3.

A central bag 8 and a ring tube 9 which serve as abutment members brought into contact with the elastic pad 4 are mounted in a space defined between the elastic pad 4 and the subcarrier plate 6. In the present embodiment, as shown in FIGS. 2 and 3, the central bag 8 is disposed centrally on a lower surface of the subcarrier plate 6, and the ring tube 9 is disposed radially outward of the central bag 8 in surrounding relation thereto. Each of the elastic pad 4, the central bag 8, and the ring tube 9 is made of a highly strong and durable rubber material such as ethylene propylene rubber (EPDM), polyurethane rubber, or silicone rubber.

The space defined between the subcarrier plate 6 and the elastic pad 4 is divided into a plurality of spaces (second pressure chamber) by the central bag 8 and the ring tube 9. Accordingly, a pressure chamber 22 is defined between the central bag 8 and the ring tube 9, and a pressure chamber 23 is defined radially outward of the ring tube 9.

The central bag 8 includes an elastic membrane 81 brought into contact with the upper surface of the elastic pad 4, and a central bag holder 82 for detachably holding the elastic membrane 81 in position. The central bag holder 82 has threaded holes 82*a* defined therein, and the central bag 8 is detachably fastened to a center of a lower surface of the subcarrier plate 6 by screws 55 threaded into the threaded holes 82*a*. The central bag 8 has a central pressure chamber 24 (third pressure chamber) defined therein by the elastic membrane 81 and the central bag holder 82.

Similarly, the ring tube 9 comprises an elastic membrane 91 brought into contact with the upper surface of the elastic pad 4, and a ring tube holder 92 for detachably holding the elastic membrane 91 in position. The ring tube holder 92 has threaded holes 92*a* defined therein, and the ring tube 9 is detachably fastened to the lower surface of the subcarrier plate 6 by screws 56 threaded into the threaded holes 92*a*. The ring tube 9 has an intermediate pressure chamber 25 (fourth pressure chamber) defined therein by the elastic membrane 91 and the ring tube holder 92.

Fluid passages 33, 34, 35 and 36 comprising tubes and connectors communicate with the pressure chambers 22 and 23, the central pressure chamber 24, and the intermediate pressure chamber 25, respectively. As shown in FIG. 1, the pressure chambers 22-25 are connected to the compressed air source 120 as a fluid supply source via respective regulators R3, R4, R5 and R6 connected respectively to the fluid passages 33-36. The fluid passages 31 to 36 are connected to respective regulators R1 to R6 through a rotary joint (not shown) mounted on an upper end of the top ring shaft 110.

The pressure chamber 21 above the subcarrier plate 6 and the pressure chambers 22-25 are supplied with pressurized fluids such as pressurized air or atmospheric air or evacuated, via the fluid passages 31, 33, 34, 35 and 36 connected to respective pressure chambers. As shown in FIG. 1, the regulators R2-R6 connected to the fluid passages 31, 33, 34, 35 and 36 of the pressure chambers 21-25 can respectively regulate pressures of pressurized fluids supplied to the respective pressure chambers. Thus, it is possible to independently control the pressures in the pressure chambers 21-25 or independently introduce atmospheric air or vacuum into the pressure chambers 21-25. In this manner, the pressures in the pressure chambers 21-25 are independently varied with the regulators R2-R6, so that pressing forces to press the semiconductor wafer W via the elastic pad 4 against the polishing pad 101 can be adjusted in local areas of the semiconductor wafer W. In some applications, the pressure chambers 21-25 may be connected to a vacuum source 121 such as a vacuum pump.

In this case, pressurized fluid or atmospheric air supplied to the pressure chambers 22-25 may independently be controlled in terms of temperature. With this configuration, it is possible to directly control a temperature of a substrate such as a semiconductor wafer from a backside of a surface to be polished. Particularly, when each of the pressure chambers is independently controlled in terms of temperature, a rate of chemical reaction can be controlled in a chemical polishing process of CMP.

As shown in FIG. 3, the elastic pad 4 has a plurality of openings 41. Inner suction portions 61 project downward from the subcarrier plate 6 so as to be exposed through respective openings 41 which are positioned between the central bag 8 and the ring tube 9. Outer suction portions 62 project downward from the subcarrier plate 6 so as to be exposed through respective openings 41 which are positioned radially outward of the ring tube 9. In this embodiment, the elastic pad 4 has eight openings 41, and the suction portions 61 and 62 are exposed through these openings 41.

The inner suction portions 61 and the outer suction portions 62 have communication holes 61*a* and 62*a* communicating with fluid passages 37 and 38, respectively. The suction portions 61 and 62 are connected to the vacuum source 121 such as a vacuum pump via the fluid passages 37 and 38 and valves V1 and V2. When the communication holes 61*a* and 62*a* of the suction portions 61 and 62 are connected to the vacuum source 121, a negative pressure is developed at lower opening ends of the communication holes 61*a* and 62*a* thereof to attract a semiconductor wafer W to the lower ends of the suction portions 61 and 62. The suction portions 61 and 62 have elastic sheets 61*b*, 62*b*, such as thin rubber sheets, attached to their lower ends, for thereby elastically contacting and holding the semiconductor wafer W on lower surfaces thereof.

As shown in FIG. 2, while the semiconductor wafer W is being polished, the suction portions 61 and 62 are positioned above a lower surface of the elastic pad 4, and thus do not project from the lower surface of the elastic pad 4. When attracting the semiconductor wafer W, the lower end surfaces of the suction portions 61 and 62 are positioned substantially in the same plane as the lower surface of the elastic pad 4.

Since there is the small gap G between the outer circumferential surface of the elastic pad 4 and the inner circumferential surface of the retainer ring 3, the holder ring 5, the subcarrier plate 6, and the elastic pad 4 attached to the subcarrier plate 6 can be moved vertically with respect to the top ring body 2 and the retainer ring 3, and hence are of a floating structure with respect to the top ring body 2 and the retainer ring 3. The stopper 5*b* of the holder ring 5 has a plurality of teeth 5*c* projecting radially outward from an outer circumferential edge thereof. Downward movement of the members including the holder ring 5 is limited to a predetermined range by engaging the teeth 5*c* with an upper surface of the radially inward projecting portion of the retainer ring 3.

Next, operation of the top ring 1 thus constructed will be described in detail below.

In the polishing apparatus constructed above, when a semiconductor wafer W is to be delivered to the polishing table 100, the top ring 1 as a whole is moved to a pusher, which is described later, and the communication holes 61*a* and 62*a* of the suction portions 61 and 62 are connected via the fluid passages 37 and 38 to the vacuum source 121. The semiconductor wafer W is attracted under vacuum to the lower ends of the suction portions 61 and 62 by suction effect of the communication holes 61*a* and 62*a*. With the semiconductor wafer W attracted to the top ring 1, the top ring 1 as a whole is moved to a position above the polishing table 100 having the polishing surface (polishing pad 101) thereon. An outer circumferential edge of the semiconductor wafer W is held (confined) by the retainer ring 3 so that the semiconductor wafer W is not removed from the top ring 1.

For polishing the semiconductor wafer W, attraction of semiconductor wafer W by the suction portions 61 and 62 is released, and the semiconductor wafer W is held on a lower surface of the top ring 1. Simultaneously, the top ring air cylinder 111 connected to the top ring drive shaft 11 is actuated to press the retainer ring 3 fixed to the lower end of the top ring 1 against the polishing surface on the polishing table 100 under a predetermined pressure. In such a state, pressurized fluids are respectively supplied to the pressure chambers 22, 23, the central pressure chamber 24, and the intermediate pressure chamber 25 under respective pressures, thereby pressing the semiconductor wafer W against the polishing surface on the polishing table 100. The polishing liquid supply nozzle 102 supplies a polishing liquid Q onto the polishing pad 101 in advance, so that the polishing liquid Q is held on the polishing pad 101. Thus, the semiconductor wafer W is polished by the polishing pad 101 with the polishing liquid Q being present between a (lower) surface, to be polished, of the semiconductor wafer W and the polishing pad 101.

Local areas of the semiconductor wafer W that are positioned beneath the pressure chambers 22 and 23 are pressed against the polishing surface under the pressures of the pressurized fluids supplied to the pressure chambers 22 and 23. A local area of the semiconductor wafer W that is positioned beneath the central pressure chamber 24 is pressed via the elastic membrane 81 and the elastic pad 4 of the central bag 8 against the polishing surface under pressure of the pressurized fluid supplied to the central pressure chamber 24. A local area of the semiconductor wafer W that is positioned beneath the intermediate pressure chamber 25 is pressed via the elastic membrane 91 and the elastic pad 4 of the ring tube 9 against the polishing surface under pressure of the pressurized fluid supplied to the intermediate pressure chamber 25.

Therefore, polishing pressures acting on respective local areas of the semiconductor wafer W can be adjusted independently by controlling the pressures of the pressurized fluids supplied to the respective pressure chambers 22-25. Specifically, the respective regulators R3-R6 independently regulate the pressures of the pressurized fluids supplied to the pressure chambers 22-25 for thereby adjusting pressing forces applied to press the local areas of the semiconductor wafer W against the polishing pad 101 on the polishing table 100. With polishing pressures on respective local areas of the semiconductor wafer W being adjusted independently to desired values, the semiconductor wafer W is pressed against the polishing pad 101 on the polishing table 100 that is being rotated. Similarly, the pressure of the pressurized fluid supplied to the top ring air cylinder 111 can be regulated by the regulator R1 to adjust a force with which the retainer ring 3 presses the polishing pad 101. While the semiconductor wafer W is being polished, the force with which the retainer ring 3 presses the polishing pad 101 and the pressing force with which the semiconductor wafer W is pressed against the polishing pad 101 can appropriately be adjusted for thereby applying polishing pressures in a desired pressure distribution to a central area (C1 in FIG. 3), an inner area (C2) between the central area and an intermediate area, the intermediate area (C3), a peripheral area (C4) of the semiconductor wafer W, and a peripheral portion of the retainer ring 3 which is positioned outside of the semiconductor wafer W.

The semiconductor wafer W has a portion positioned beneath the pressure chambers 22 and 23. In this portion, there exist two areas. One is pressed by pressurized fluid through the elastic pad 4, and the other is pressed directly by the pressurized fluid. The latter is an area whose position corresponds to the opening 41. These two areas may be pressed under the same pressing force. Since, the elastic pad 4 is held in intimate contact with a reverse side of the semiconductor wafer W near the openings 41, the pressurized fluids in the pressure chambers 22 and 23 are essentially prevented from leaking to an exterior.

In this manner, the semiconductor wafer W is divided into four concentric circular and annular areas (C1 to C4), which can respectively be pressed under independent pressing forces. A polishing rate depends on a pressing force applied to a semiconductor wafer W against a polishing surface. As described above, since the pressing forces applied to those areas can independently be controlled, polishing rates of the four circular and annular areas (C1 to C4) of the semiconductor wafer W can independently be controlled. Consequently, even if a thickness of a thin film to be polished on the surface of the semiconductor wafer W suffers radial variations, the thin film on the surface of the semiconductor wafer W can be polished uniformly without being insufficiently or excessively polished over an entire surface of the semiconductor wafer. More specifically, even if the thickness of the thin film to be polished on the surface of the semiconductor wafer W differs depending on a radial position on the semiconductor wafer W, a pressure in a pressure chamber positioned over a thicker area of the thin film is made higher than pressure in other pressure chambers, or a pressure in a pressure chamber positioned over a thinner area of the thin film is made lower than the pressure in other pressure chambers. In this manner, a pressing force applied to the thicker area of the thin film against the polishing surface is made higher than a pressing force applied to the thinner area of the thin film against the polishing surface, thereby selectively increasing a polishing rate of the thicker area of the thin film. Consequently, an entire surface of the semiconductor wafer W can be polished exactly to a desired level over the entire surface of the semiconductor wafer W irrespective of a film thickness distribution produced at a time the thin film is formed.

Any unwanted edge rounding on the circumferential edge of the semiconductor wafer W can be prevented by controlling a pressing force applied to the retainer ring 3. If the thin film to be polished on the circumferential edge of the semiconductor wafer W has large thickness variations, then the pressing force applied to the retainer ring 3 is intentionally increased or reduced to thus control a polishing rate of the circumferential edge of the semiconductor wafer W. When the pressurized fluids are supplied to the pressure chambers 22-25, the subcarrier plate 6 is subjected to upward forces. In the present embodiment, the pressurized fluid is supplied to the pressure chamber 21 via the fluid passage 31 to prevent the subcarrier plate 6 from being lifted under forces due to the pressure chambers 22-25.

As described above, the pressing force applied by the top ring air cylinder 111 to press the retainer ring 3 against the polishing pad 101, and the pressing forces applied by the pressurized air supplied to the pressure chambers 22-25 to press the local areas of the semiconductor wafer W against the polishing pad 101, are appropriately adjusted to polish the semiconductor wafer W. When polishing of the semiconductor wafer W is finished, the semiconductor wafer W is attracted to the lower ends of the suction portions 61 and 62 under vacuum in the same manner as described above. At this time, supply of the pressurized fluids into the pressure chambers 22-25 to press the semiconductor wafer W against the polishing surface is stopped, and the pressure chambers 22-25 are vented to an atmosphere. Accordingly, the lower ends of the suction portions 61 and 62 are brought into contact with the semiconductor wafer W. The pressure chamber 21 is vented to the atmosphere or evacuated to develop a negative pressure therein. If the pressure chamber 21 is maintained at a high pressure, then the semiconductor wafer W is strongly pressed against the polishing surface only in areas brought into contact with the suction portions 61 and 62. Therefore, it is necessary to decrease the pressure in the pressure chamber 21 immediately. Accordingly, as shown in FIG. 2, a relief port 39 penetrating from the pressure chamber 21 through the top ring body 2 may be provided for decreasing pressure in the pressure chamber 21 immediately. In this case, when the pressure chamber 21 is pressurized, it is necessary to continuously supply pressurized fluid into the pressure chamber 21 via the fluid passage 31. The relief port 39 has a check valve for preventing an outside air from flowing into the pressure chamber 21 at a time when a negative pressure is developed in the pressure chamber 21.

After attraction of the semiconductor wafer W, the top ring 1 as a whole is moved to a position to which the semiconductor wafer W is to be transferred, and then a fluid (e.g., compressed air or a mixture of nitrogen and pure water) is ejected to the semiconductor wafer W via the communication holes 61*a* and 62*a* of the suction portions 61 and 62 to release the semiconductor wafer W from the top ring 1.

The polishing liquid Q used to polish the semiconductor wafer W tends to flow through the small gap G between the outer circumferential surface of the elastic pad 4 and the retainer ring 3. If the polishing liquid Q is firmly deposited in the gap G, then the holder ring 5, the subcarrier plate 6, and the elastic pad 4 are prevented from smoothly moving vertically with respect to the top ring body 2 and the retainer ring 3. To avoid such a drawback, a cleaning liquid (pure water) is supplied through the fluid passage 32 to the cleaning liquid passage 51. Accordingly, the pure water is supplied via a plurality of communication holes 53 to a region above the gap G, thus cleaning the gap G to prevent the polishing liquid Q from being firmly deposited in the gap G. The pure water should preferably be supplied after a polished semiconductor wafer W is released and until a next semiconductor wafer to be polished is attracted to the top ring 1. It is also preferable to discharge all supplied pure water out of the top ring 1 before the next semiconductor wafer is polished, and hence to provide the retainer ring 3 with a plurality of through-holes 3*a* shown in FIG. 2. Furthermore, if a pressure buildup is developed in a space 26 defined between the retainer ring 3, the holder ring 5, and the pressurizing sheet 7, then it acts to prevent the subcarrier plate 6 from being elevated in the top ring body 2. Therefore, in order to allow the subcarrier plate 6 to be elevated smoothly in the top ring body 2, the through-holes 3*a* should preferably be provided for equalizing pressure in the space 26 with atmospheric pressure.

As described above, pressures in the pressure chambers 22, 23, the pressure chamber 24 in the central bag 8, and the pressure chamber 25 in the ring tube 9 are independently controlled to control pressing forces acting on the semiconductor wafer W. Further, it is possible to easily change areas in which a pressing force is controlled by changing positions and sizes of the central bag 8 and the ring tube 9.

Figure 4:
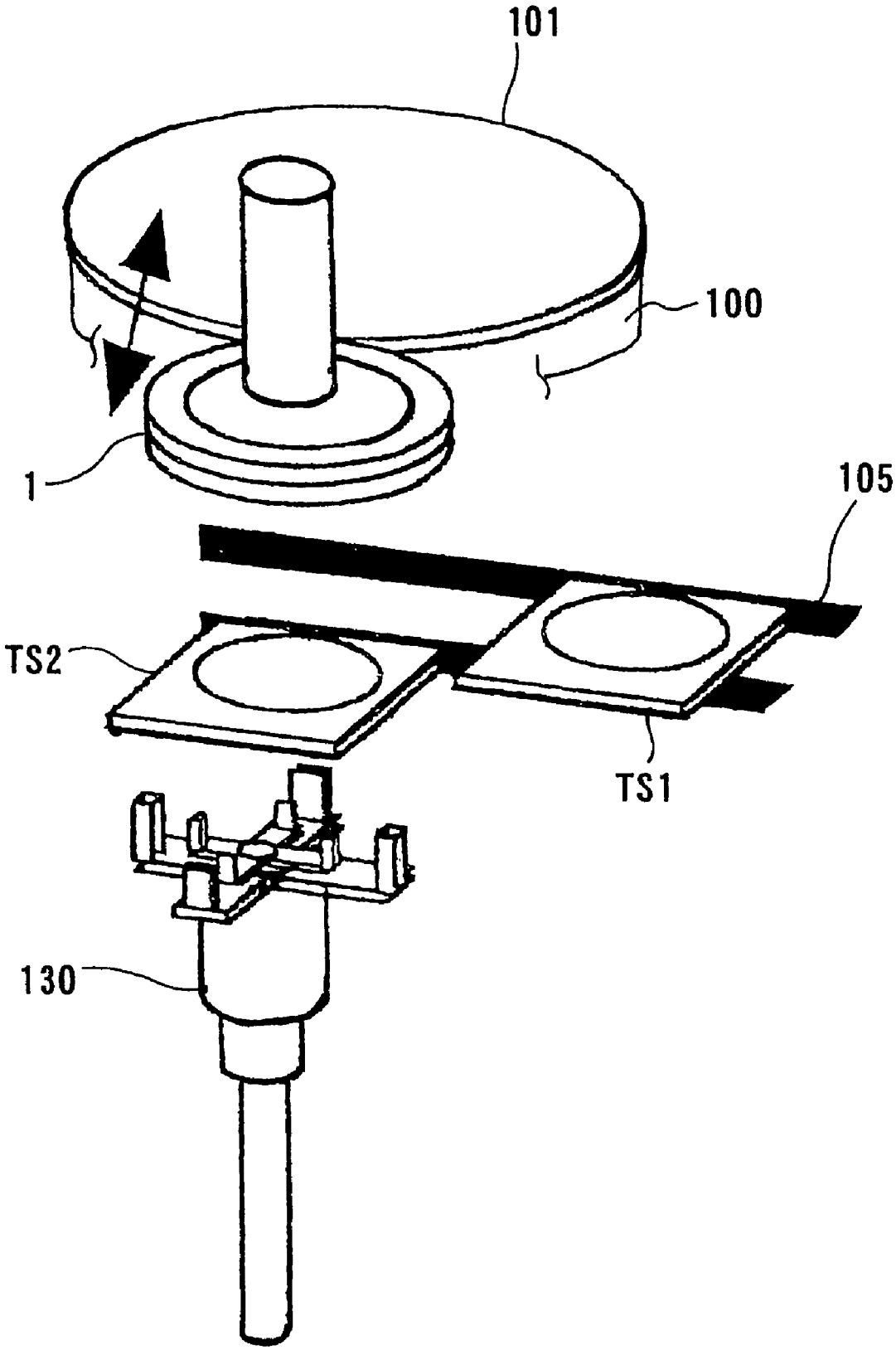
FIG. 4 is a perspective view showing a relationship between a pusher, the top ring, and a linear transporter in the polishing apparatus shown in FIG. 1.

There will be described below a pusher, which serves as a substrate relay device to transfer a semiconductor wafer between the top ring 1 and a linear transporter. FIG. 4 is a perspective view showing a relationship between a pusher 130, the top ring 1, and a linear transporter 105. The pusher 130 serves to receive a semiconductor wafer from a first transfer stage TS1 of the linear transporter 105 and deliver the semiconductor wafer to the top ring 1, and also serves to receive a polished semiconductor wafer from the polishing table 100 via the top ring 1 and deliver the semiconductor wafer to a second transfer stage TS2 of the linear transporter 105. Thus, the pusher 130 serves as a receiving/delivering mechanism for receiving and delivering semiconductor wafers between the linear transporter 105 and the top ring 1.

Figure 5:
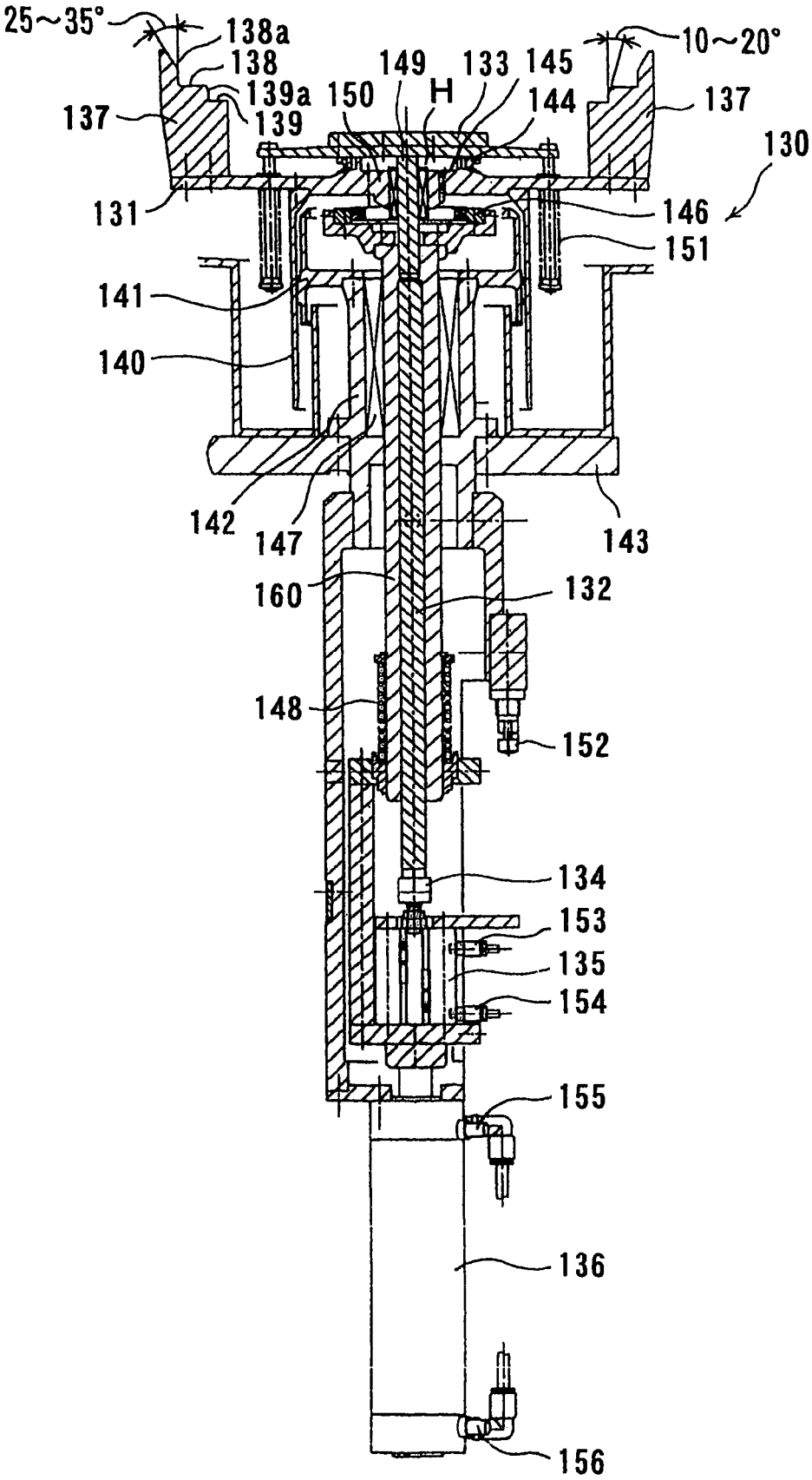
FIG. 5 is a vertical cross-sectional view showing details of the pusher in the polishing apparatus shown in FIG. 1.

FIG. 5 is a vertical cross-sectional view showing details of the pusher 130. As shown in FIG. 5, the pusher 130 has a guide stage 131 provided above a hollow shaft 160 for holding the top ring, a spline shaft 132 extending through the hollow shaft 160, and a push stage 133 provided above the spline shaft 132 for holding a semiconductor wafer thereon. The push stage 133 serves as a substrate placement section having a substrate placement surface on which a semiconductor wafer is placed. Air cylinders 135 and 136 are coupled to the spline shaft 132 through a floating joint 134, which can flexibly be connected to the shaft against displacement of the shaft. The two air cylinders 135 and 136 are disposed vertically in series. Lower air cylinder 136 serves to lift and lower the guide stage 131 and the push stage 133. The lower air cylinder 136 lifts and lowers the hollow shaft 160 together with upper air cylinder 135. The air cylinder 135 serves as a moving mechanism to lift and lower the push stage 133.

Four top ring guides 137 are provided at an outer circumferential portion of the guide stage 131. Each top ring guide 137 has a two-stage structure including an upper stage 138 and a lower stage 139. The upper stages 138 of the top ring guides 137 serve as contact portions with a lower surface of the retainer ring 3 (see FIG. 6) of the top ring, whereas the lower stages 139 serve as centering portions for centering a semiconductor wafer and support portions for supporting the semiconductor wafer. The upper stage 138 has a tapered surface 138*a*, formed preferably at an angle of about 25° to about 35°, for guiding the top ring toward the upper stage 138. The lower stage 139 has a tapered surface 139*a*, formed preferably at an angle of about 10° to about 20°, for guiding the semiconductor wafer W toward the lower stage 139. When the semiconductor wafer is unloaded from the top ring, the top ring guides 137 directly receive a peripheral edge of the semiconductor wafer.

A guide sleeve 140 having a water proof function and a function for guiding the guide stage 131 so as to be returned to its original position is provided below the guide stage 131. A central sleeve 141 for centering the pusher is fixed to a bearing case 142 located inside of the guide sleeve 140. The pusher 130 is connected through the bearing case 142 to a motor housing 143 in a polishing section.

Further, a V-ring 144 is used to prevent water from entering between the push stage 133 and the guide stage 131. The V-ring 144 has a lip held in contact with the guide stage 131 to prevent water from passing therethrough. When the guide stage 131 is lifted, a volume of a portion H is increased to lower pressure in portion H so as to draw water into portion H. In order to prevent water from being drawn into portion H, a hole 145 is defined in an inner side of the V-ring 144 for preventing pressure in portion H from being lowered.

The pusher 130 has a linear way 146 movable in directions of an X-axis and a Y-axis for allowing the top ring guides 137 to have an alignment mechanism. The guide stage 131 is fixed to the linear way 146. The linear way 146 is fixed to the hollow shaft 160. The hollow shaft 160 is held through a slide bush 147 by the bearing case 142. A stroke of the air cylinder 136 is transmitted through a compression spring 148 to the hollow shaft 160.

The push stage 133 is located above the guide stage 131. The push stage 133 has a push rod 149 extending downward from a center of the push stage 133. The push rod 149 extends through a slide bush 150 located at a center of the guide stage 131 so that the push rod 149 is centered. The push rod 149 is brought into contact with an upper end of the spline shaft 132. The push stage 133 is vertically moved by the spline shaft 132 with the cylinder 135 so that the semiconductor wafer W is loaded on the top ring 1. The push stage 133 has compression springs 151 provided at a peripheral portion thereof for positioning the push stage 133.

A shock killer 152 is provided for positioning the top ring guides 137 in a vertical direction and for shock-absorbing when the top ring guides 137 contact the top ring 1. Each of the air cylinders has upper and lower limit sensors for detecting a position of the pusher in a vertical direction. Specifically, the air cylinder 135 has sensors 153 and 154, and the air cylinder 136 has sensors 155 and 156. The pusher 130 has a cleaning nozzle for cleaning the pusher 130 so as to prevent slurry attached to the pusher from contaminating a semiconductor wafer. The pusher may have a sensor for detecting presence of a semiconductor wafer positioned on the pusher. The air cylinders 135 and 136 are controlled by double solenoid valves, respectively.

Operation of the pusher 130 thus constructed will be described below. FIGS. 6A through 6E are views explanatory of operation of the pusher 130.

1) Loading a Semiconductor Wafer

Figures 6A, 6B, 6C, 6D, 6E:
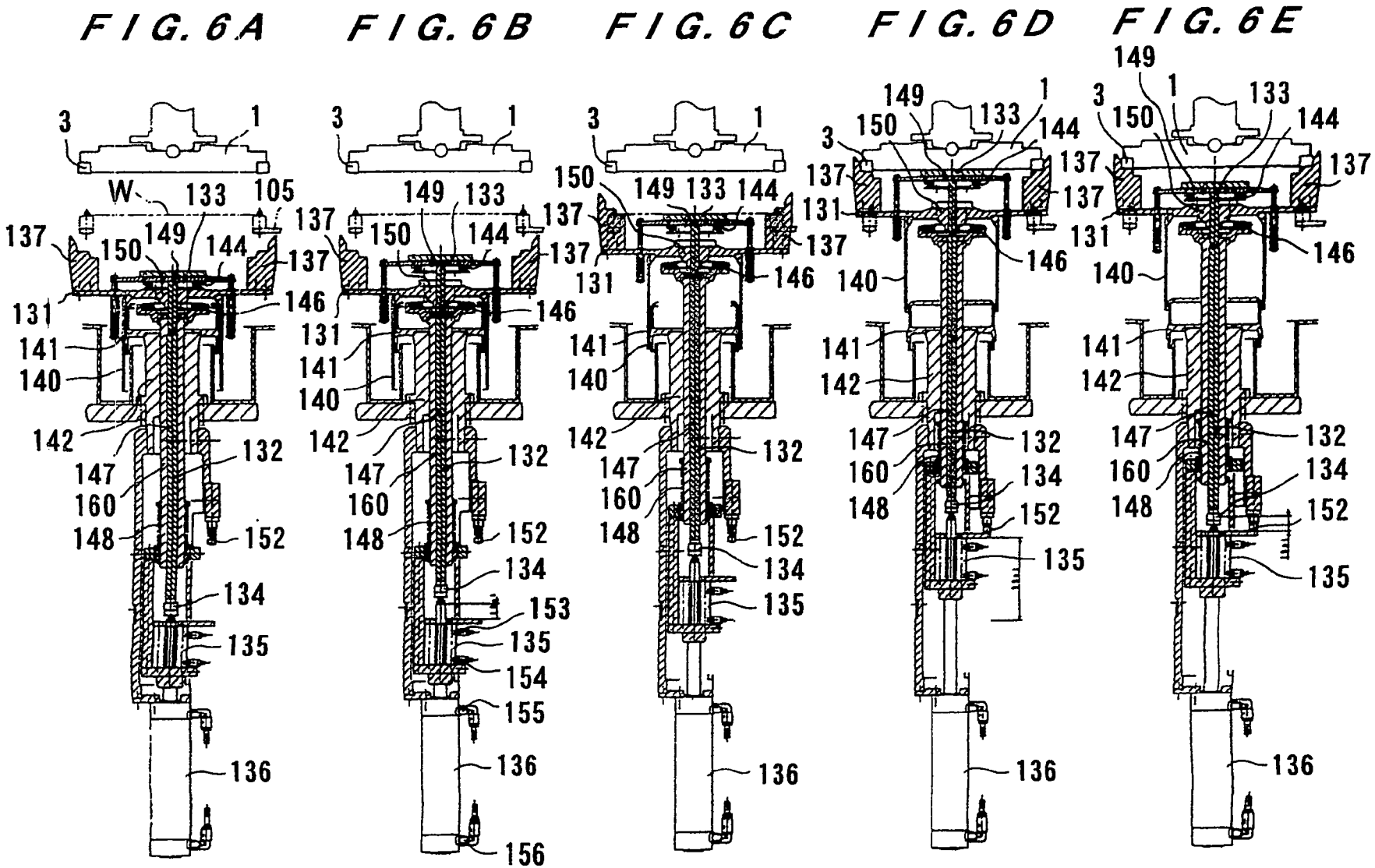
FIGS. 6A through 6E are vertical cross-sectional views explanatory of operation of the pusher shown in FIG. 5.

As shown in FIG. 6A, a semiconductor wafer W is transferred to a position above the pusher 130 by the linear transporter 105. When the top ring 1 is located at a wafer loading position above the pusher 130 and does not hold the semiconductor wafer, the push stage 133 is lifted by the air cylinder 135, as shown in FIG. 6B. When the sensor 153 detects completion of lifting the push stage 133, the guide stage 131 and components associated with the guide stage 131 are lifted by the air cylinder 136, as shown in FIG. 6C. While the guide stage 131 is lifted, the guide stage 131 passes through a semiconductor wafer holding position of the transfer stage of the linear transporter 105. At that time, the semiconductor wafer W is centered by the tapered surfaces 139*a* of the top ring guides 137 and held by the push stage 133 at a pattern surface of the semiconductor wafer W (at portions other than a peripheral edge thereof).

While the push stage 133 holds the semiconductor wafer W, the top ring guides 137 are lifted without being stopped, and the retainer ring 3 is guided by the tapered surfaces 138*a* of the top ring guides 137. A center of the top ring guides 137 is aligned with a center of the top ring 1 by the linear way 146 movable in X and Y directions, and the upper stages 138 of the top ring guides 137 contact the lower surface of the retainer ring 3 and lifting of the guide stage 131 is stopped.

When the upper stages 138 of the top ring guides 137 are brought into contact with the lower surface of the retainer ring 3, the guide stage 131 is fixed and is not lifted anymore. However, the air cylinder 136 continues a lifting motion until the air cylinder 136 is brought into contact with the shock killer 152. Accordingly, only the spline shaft 132 continues to be lifted because the compression spring 148 is compressed, and the push stage 133 is further lifted. At that time, as shown in FIG. 6D, the push stage 133 holds the semiconductor wafer W at the pattern surface of the semiconductor wafer W (at portions other than the peripheral edge thereof), and transports the semiconductor wafer W to the top ring 1. After the semiconductor wafer W is brought into contact with the top ring 1, a lifting stroke of the cylinder 136 is absorbed by the springs 151 to thereby protect the semiconductor wafer W.

2) Unloading a Semiconductor Wafer

The semiconductor wafer W is transported by the top ring 1 to a wafer unloading position located above the pusher 130. When the transfer stage of the linear transporter 105 is located above the pusher 130 and does not hold the semiconductor wafer, the guide stage 131 and the components associated with the guide stage 131 are lifted by the air cylinder 136, and the retainer ring 3 is guided by the tapered surfaces 138*a* of the top ring guides 137. The center of the top ring guides 137 is aligned with the center of the top ring 1 by the linear way 146, and the upper stages 138 of the top ring guides 137 are brought into contact with the lower surface of the retainer ring 3 and lifting of the guide stage 131 is stopped.

The air cylinder 136 continues to be actuated until the air cylinder 136 contacts the shock killer 152. However, since the upper stages 138 of the top ring guides 137 contact the lower surface of the retainer ring 3 to cause the guide stage 131 to be fixed at this position, the air cylinder 136 pushes the spline shaft 132 together with the air cylinder 135 against an urging force of the compression spring 148, thus lifting the push stage 333. At that time, as shown in FIG. 6E, the push stage 133 is not raised to a position higher than the semiconductor wafer holding portion of the lower stages 139 of the top ring guides 137. In this embodiment, the air cylinder 136 is arranged to be further actuated after the top ring guides 137 contact the retainer ring 3. A shock at that time is absorbed by the compression spring 148.

After lifting actuation of the air cylinder 136 is completed, the semiconductor wafer W is released from the top ring 1. At that time, the semiconductor wafer W is centered by the lower tapered surfaces 139*a* of the top ring guides 137, and the semiconductor wafer W is held by the lower stages 139 of the top ring guides 137 at the peripheral edge of the semiconductor wafer W. After the semiconductor wafer W is held by the pusher 130, the pusher 130 starts to be lowered. While the guide stage 131 is lowered, the guide stage 131, which has moved its center for centering the top ring 1, is centered by the guide sleeve 140 and the central sleeve 141. While the guide stage 131 is lowered, the semiconductor wafer W is transferred from the pusher 130 to the linear transporter 105 at the peripheral edge thereof. When lowering of the guide stage 131 is completed, operation of the unloading of the semiconductor wafer is completed.

The pusher 130 shown in FIG. 5 has a mechanism for separating a polished semiconductor wafer reliably from the top ring 1 without any impact upon the semiconductor wafer when the semiconductor wafer is delivered from the top ring 1 to the pusher 130. Embodiments of such a mechanism will be described below with reference to FIGS. 7 through 19B.

Figure 7:
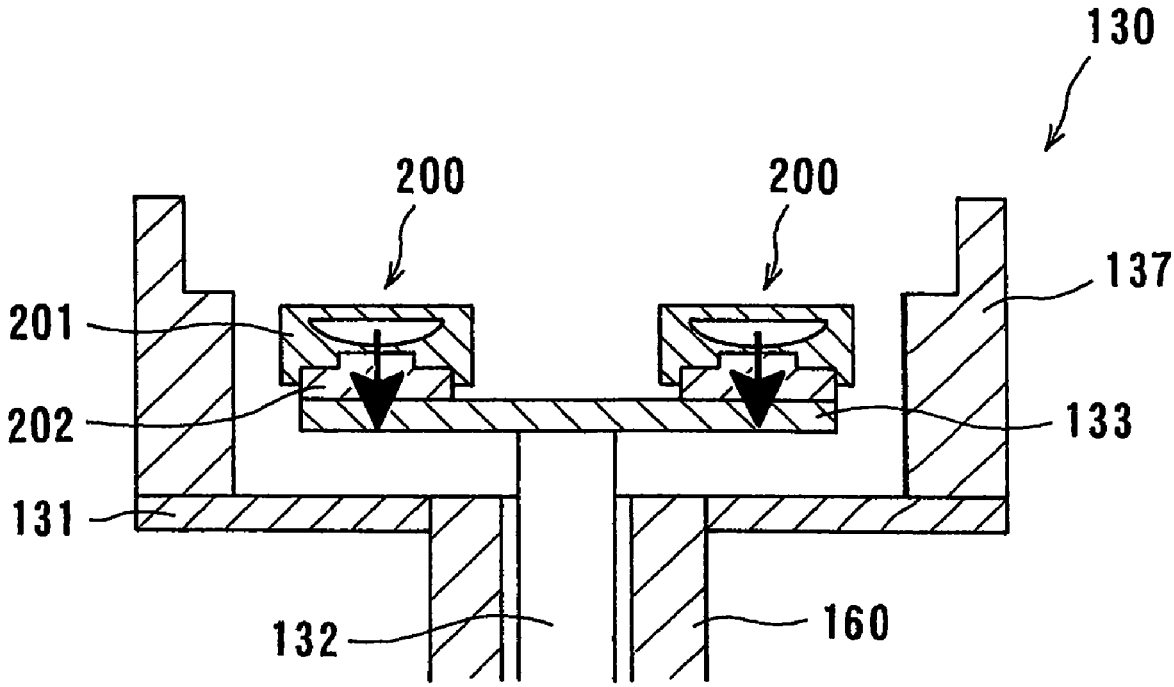
FIG. 7 is a cross-sectional view schematically showing a pusher according to a first embodiment of the present invention.

FIG. 7 shows a pusher according to a first embodiment of the present invention. FIG. 7 is a cross-sectional view schematically showing the pusher 130 and illustrates only a main part of the pusher 130. Thus, the pusher 130 is illustrated as including guide stage 131, top ring guides 137, push stage 133, spline shaft 132 to vertically move the push stage 133, and hollow shaft 160. As shown in FIG. 7, the pusher 130 has at least one attraction pad 200 as an attraction section attached on an upper surface of the push stage 133.

Figure 8:
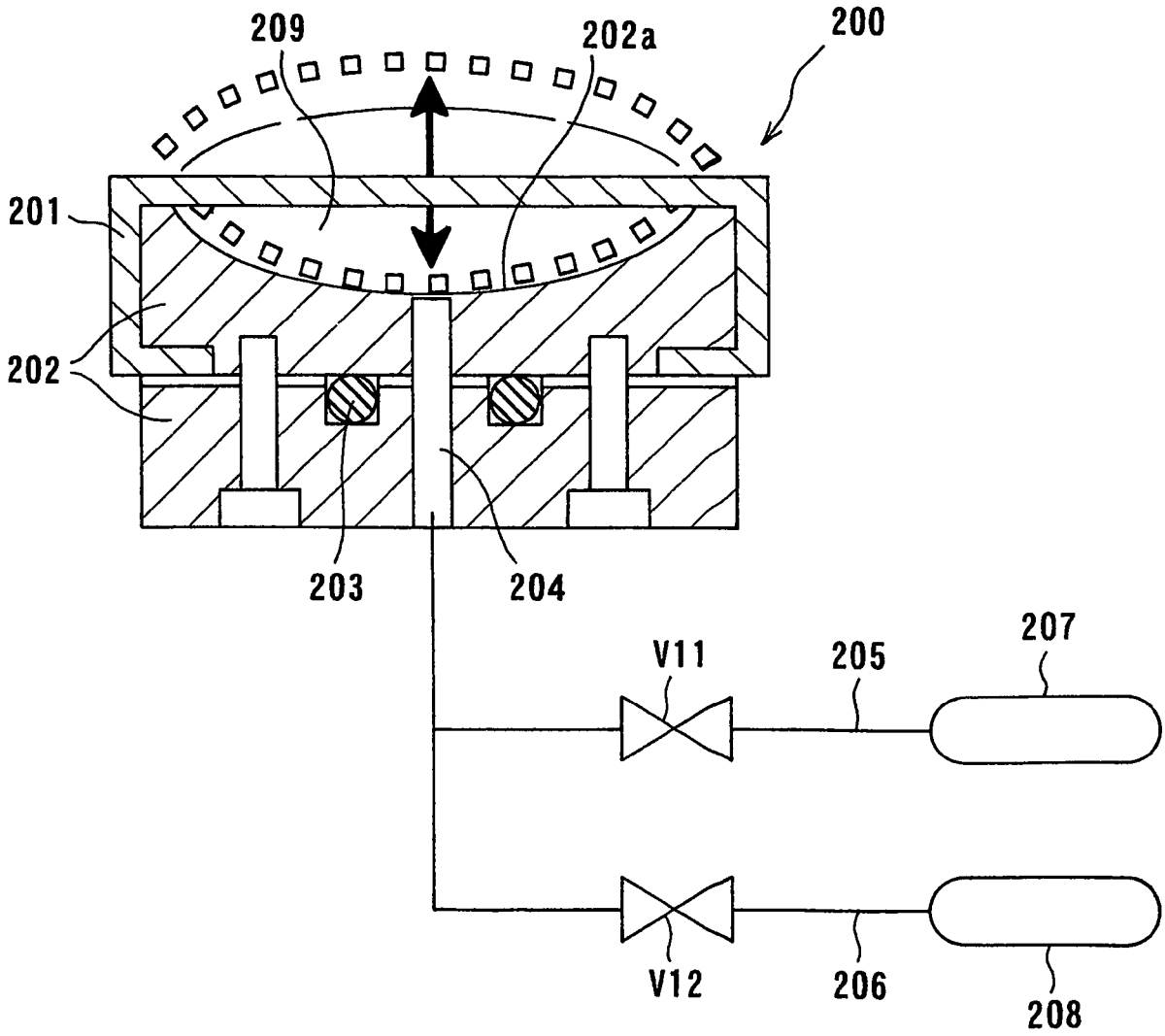
FIG. 8 is a cross-sectional view schematically showing an attraction pad of the pusher shown in FIG. 7.

FIG. 8 is a cross-sectional view showing the attraction pad 200. As shown in FIG. 8, the attraction pad 200 has an elastic body or elastic membrane 201 in a form of a bag, and an attraction pad body 202 including upper and lower members which clamp open ends of the elastic membrane 201 therebetween. The upper member of the attraction pad body 202 has a recess 202*a* in a form of a hemisphere or a bowl formed in an upper surface (chamber surface) thereof. The recess 202*a* and the elastic membrane (elastic body) 201, which covers the recess 202*a*, define a fluid chamber 209. The attraction pad 200 includes an O-ring 203 interposed between the upper and lower members of the attraction pad body 202 for sealing an interface of the upper and lower members. The upper and lower members have a communication hole 204 opened to the recess 202*a* on an upper surface of the upper member. The communication hole 204 is connected through pipes 205 and 206 to a vacuum source 207 and a compressed fluid supply source 208. A valve V11 is provided in pipe 205 which is connected to the vacuum source 207, and a valve V12 is provided in pipe 206 which is connected to the compressed fluid supply source 208.

Operation of the pusher 130 thus constructed will be described. FIGS. 9A through 9D are cross-sectional views explanatory of operation of the pusher 130.

Figures 9A, 9B, 9C, 9D:
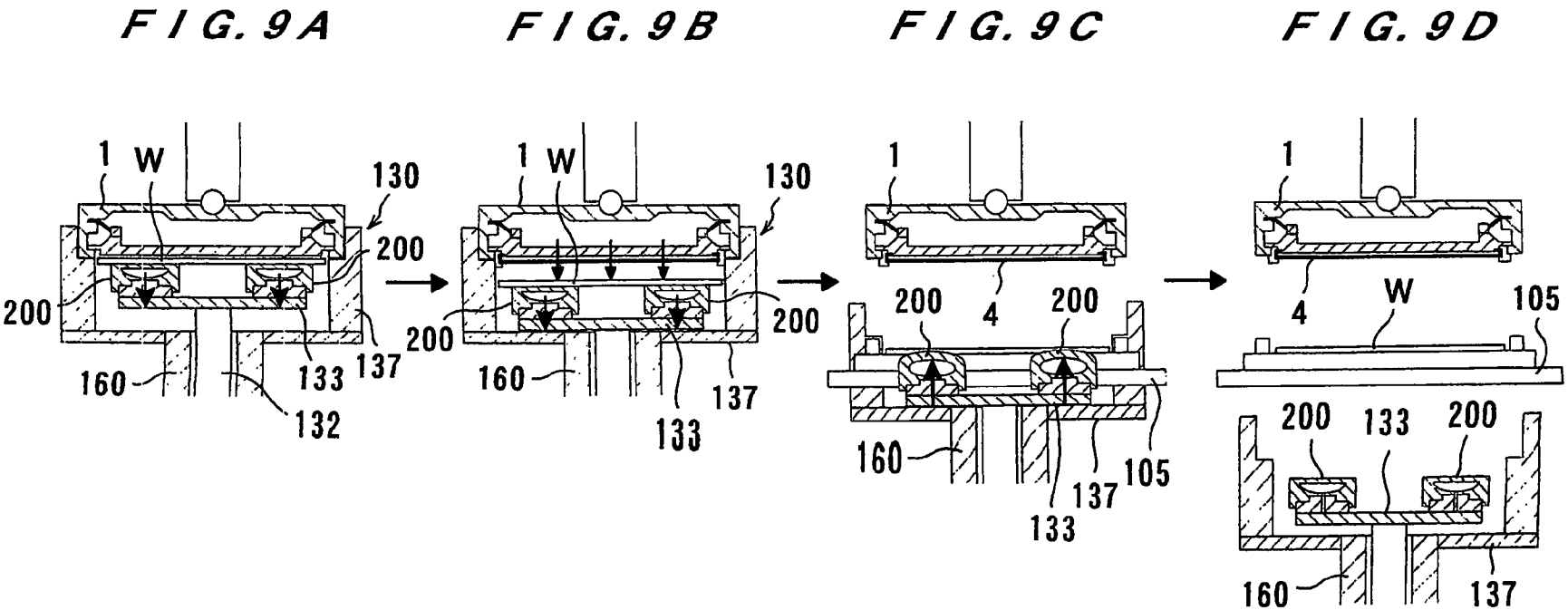
FIGS. 9A through 9D are vertical cross-sectional views explanatory of operation of the pusher shown in FIG. 7.

The top ring 1 transfers a semiconductor wafer W to a wafer unloading position located above the pusher 130. Then, air cylinder 136 (see FIG. 5) is actuated to lift the pusher 130 so that the upper surfaces of the attraction pads 200 are brought into contact with the semiconductor wafer W held by the top ring 1. Before the upper surfaces of the attraction pads 200 are brought into contact with the semiconductor wafer W, the attraction pads 200 are in a state shown in FIG. 8. At the same time as this contact of the attraction pads 200, the valve V11 is opened so as to connect the fluid chambers 209 in the attraction pads 200 to the vacuum source 207. Accordingly, as shown in FIG. 9A, the elastic membranes 201 of the attraction pads 200 become depressed like suckers, so that the attraction pads 200 attract the semiconductor wafer W on the upper surfaces thereof.

At the same time as this attraction of the semiconductor wafer W to the attraction pads 200, a pressurized fluid (e.g., compressed air or a mixture of nitrogen and pure water) is ejected to the semiconductor wafer W through the communication holes 61*a* and 62*a* (see FIG. 2) of the suction portions 61 and 62 of the top ring 1 to release the semiconductor wafer W from the top ring 1. When the pressurized fluid is ejected through the communication holes 61*a* and 62*a* to the semiconductor wafer W, a pressurized fluid may be supplied to all of or part of the pressure chambers 22-25 to swell membrane (elastic pad) 4 so as to push the semiconductor wafer W. Thus, the semiconductor wafer W can completely be removed from the top ring 1 by the attraction of the semiconductor wafer W to the attraction pads 200, ejection of the pressurized fluid from the top ring 1, and pressurization of the membrane 4 of the top ring 1. Thereafter, as shown in FIG. 9B, the push stage 133 is lowered so as to space the semiconductor wafer W from the top ring 1 while the semiconductor wafer W is attracted to the attraction pads 200.

Then, the valve V11 is closed, and the valve V12 is opened. Thus, as shown in FIG. 9C, a pressurized fluid such as a nitrogen gas is introduced from the compressed fluid supply source 208 into the attraction pads 200 so as to swell the attraction pads 200 like balloons. Accordingly, the semiconductor wafer W is raised from the upper members of the attraction pads 200 to release the attraction of the semiconductor wafer W to the attraction pads 200. In this state, the pusher 130 is lowered. On the way to lower the pusher 130, the semiconductor wafer W is transferred from the pusher 130 to the transfer stage of the linear transporter 105. As shown in FIG. 9D, when the pusher 130 is completely lowered, the semiconductor wafer W is completely delivered to the linear transporter 105.

As described above, according to the present embodiment, when a semiconductor wafer W is transferred from the top ring 1 to the pusher 130, the semiconductor wafer W is attracted to the attraction pads 200 of the pusher 130. Therefore, the semiconductor wafer W can reliably be removed from the top ring 1. Further, since the attraction pads 200 attract the semiconductor wafer W, it is possible to prevent the semiconductor wafer W from falling down toward the pusher 130 with force due to ejection of the pressurized fluid when the semiconductor wafer W is released from the top ring 1. Thus, the semiconductor wafer W is subjected to no impact.

Figure 10:
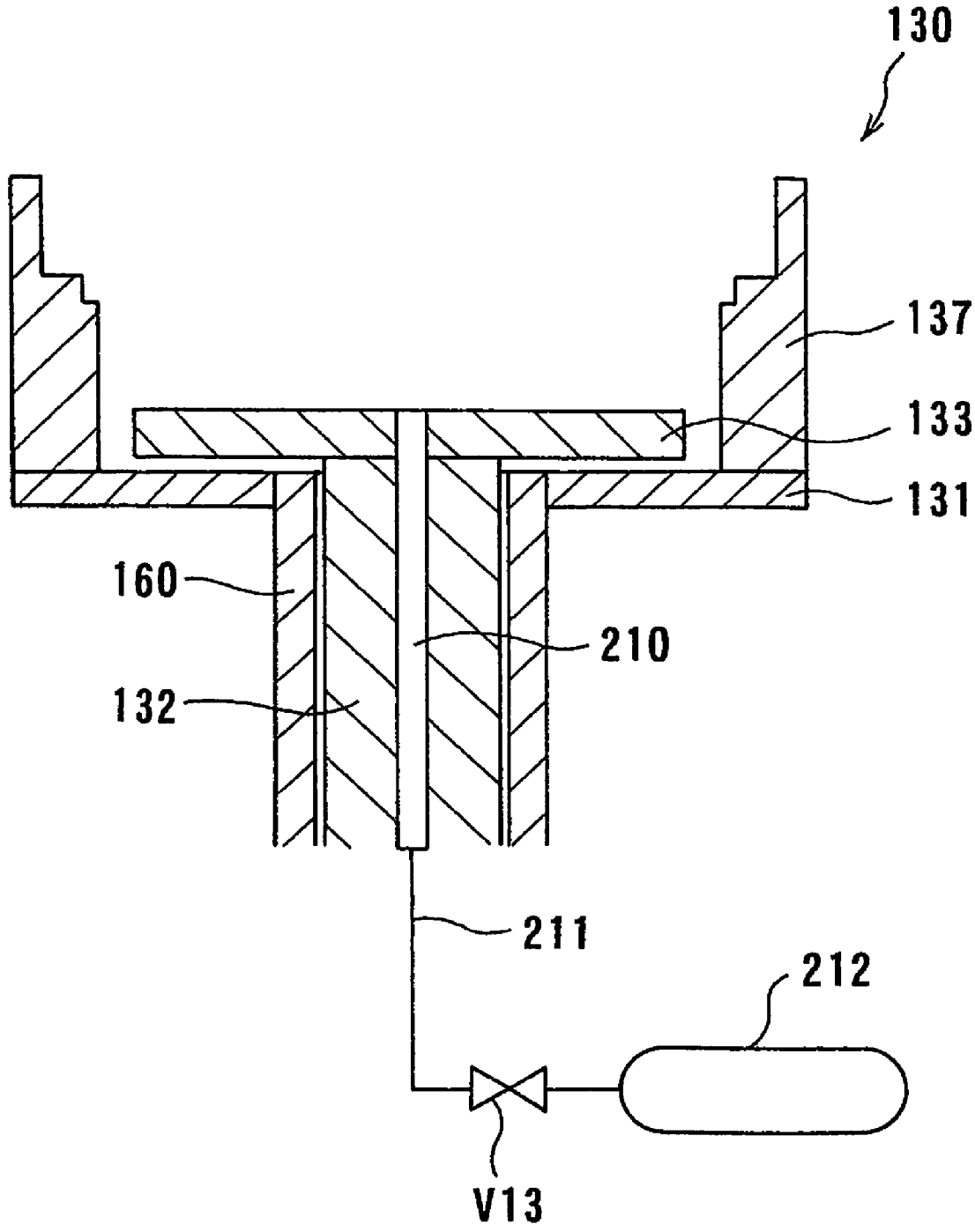
FIG. 10 is a cross-sectional view schematically showing a pusher according to a second embodiment of the present invention.

FIG. 10 shows a pusher 130 according to a second embodiment of the present invention. FIG. 10 is a cross-sectional view schematically showing the pusher 130 and illustrates only main parts of the pusher 130. Thus, the pusher 130 is illustrated as including guide stage 131, top ring guides 137, push stage 133, spline shaft 132 to vertically move the push stage 133, and hollow shaft 160. As shown in FIG. 10, the push stage 133 has a flat upper surface. The shaft 132, which vertically moves the push stage 133, and the push stage 133 have a fluid supply passage 210 connected through a pipe 211 to a pure water supply source 212. A valve V13 is provided in pipe 211 connected to the pure water supply source 212.

Operation of this pusher 130 thus constructed will be described. FIGS. 11A through 11F are cross-sectional views explanatory of operation of the pusher 130.

Figures 11A, 11B, 11C, 11D, 11E, 11F:
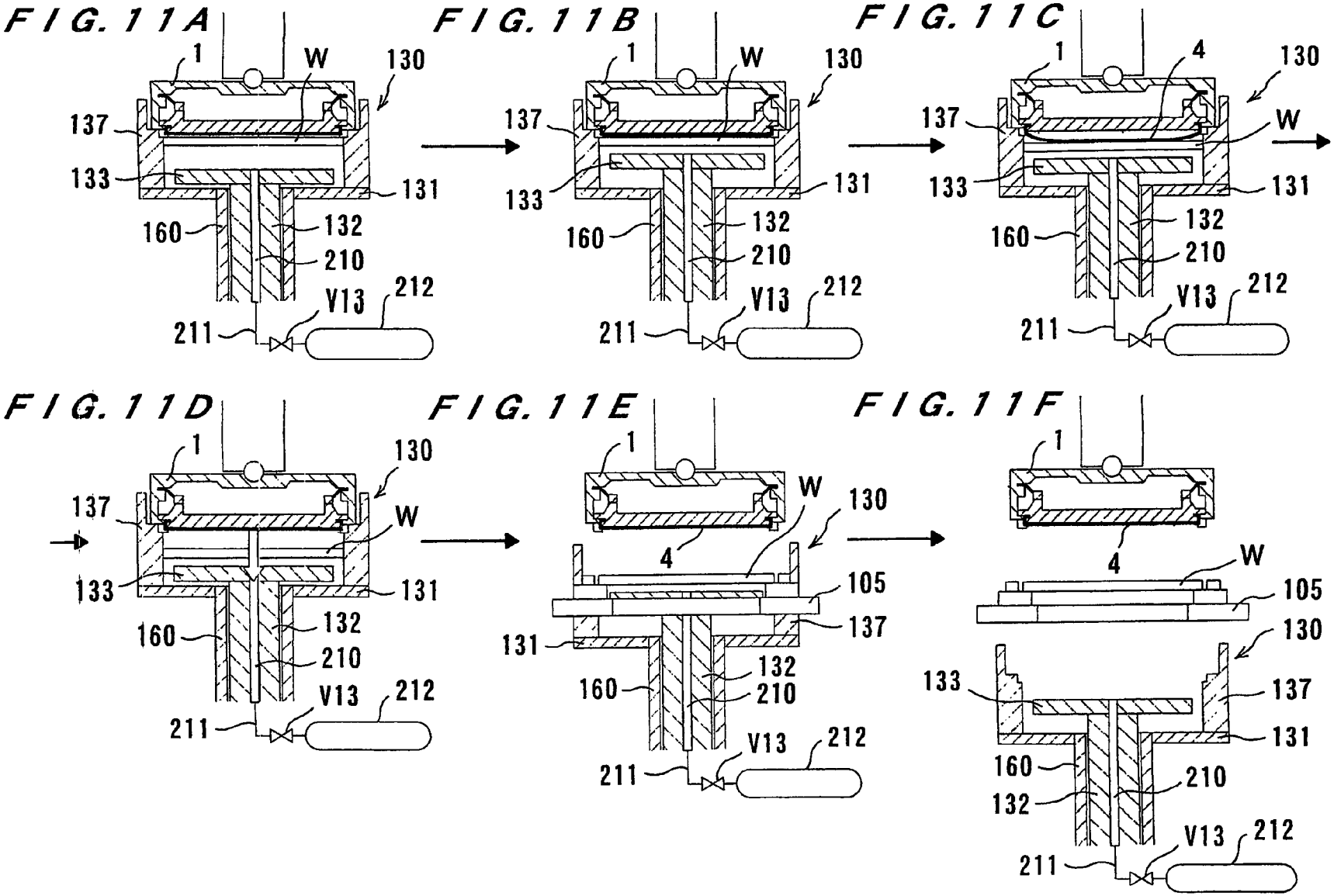
FIGS. 11A through 11F are vertical cross-sectional views explanatory of operation of the pusher shown in FIG. 10.

The top ring 1 transfers a semiconductor wafer W to a wafer unloading position located above the pusher 130. Then, air cylinder 136 (see FIG. 5) is actuated to lift the pusher 130 so that the top ring 1 is brought into engagement with the top ring guides 137 as shown in FIG. 11A. At that time, the valve V13 is opened so as to supply pure water from the pure water supply source 212 through the fluid supply passage 210 to an upper surface of the push stage 133. Thus, a thin water film is formed on the upper surface of the push stage 133. In this state, as shown in FIG. 11B, the push stage 133 is lifted so as to bring the upper surface of the push stage 133 into contact with the semiconductor wafer W. At a time of this contact, the valve V13 is closed so as to stop supply of the pure water to the upper surface of the push stage 133.

Since the thin water film is formed between the upper surface of the push stage 133 and the semiconductor wafer W, the semiconductor wafer W is attracted to the upper surface of the push stage 133 by surface tension of the water film. At the same time as this attraction of the semiconductor wafer W to the push stage 133 using the water film, a pressurized fluid (e.g., compressed air or a mixture of nitrogen and pure water) is ejected to the semiconductor wafer W through the communication holes 61*a* and 62*a* (see FIG. 2) of the suction portions 61 and 62 of the top ring 1 to release the semiconductor wafer W from the top ring 1, as shown in FIG. 11C. When the pressurized fluid is ejected through the communication holes 61*a* and 62*a* to the semiconductor wafer W, a pressurized fluid may be supplied to all of or part of the pressure chambers 22-25 to swell membrane (elastic pad) 4 so as to push the semiconductor wafer W. Thus, the semiconductor wafer W can be completely removed from the top ring 1 by attraction of the semiconductor wafer W to the push stage 133 using the water film, ejection of the pressurized fluid from the top ring 1, and pressurization of the membrane 4 of the top ring 1.

Thereafter, as shown in FIG. 9D, the push stage 133 is lowered so as to space the semiconductor wafer W from the top ring 1 while the semiconductor wafer W is attracted by the push stage 133. Then, the valve V13 is opened so as to supply and flow pure water from the pure water supply source 212 to the upper surface of the push stage 133 to thereby release the attraction of the semiconductor wafer W by the water film. In this state, as shown in FIG. 11E, the pusher 130 is lowered. On the way to lower the pusher 130, the semiconductor wafer W is transferred from the pusher 130 to the transfer stage of the linear transporter 105. As shown in FIG. 11F, when the pusher 130 is completely lowered, the semiconductor wafer W is completely delivered to the linear transporter 105.

As described above, according to the present embodiment, when a semiconductor wafer W is transferred from the top ring 1 to the pusher 130, the semiconductor wafer W is attracted by a thin water film, which is formed on the upper surface of the push stage 133 of the pusher 130. Therefore, the semiconductor wafer W can reliably be removed from the top ring 1. Further, since the semiconductor wafer W is attracted by the thin water film, it is possible to prevent the semiconductor wafer W from falling down toward the pusher 130 with force due to ejection of the pressurized fluid when the semiconductor wafer W is released from the top ring 1. Thus, the semiconductor wafer W is subjected to no impact.

Figure 12:
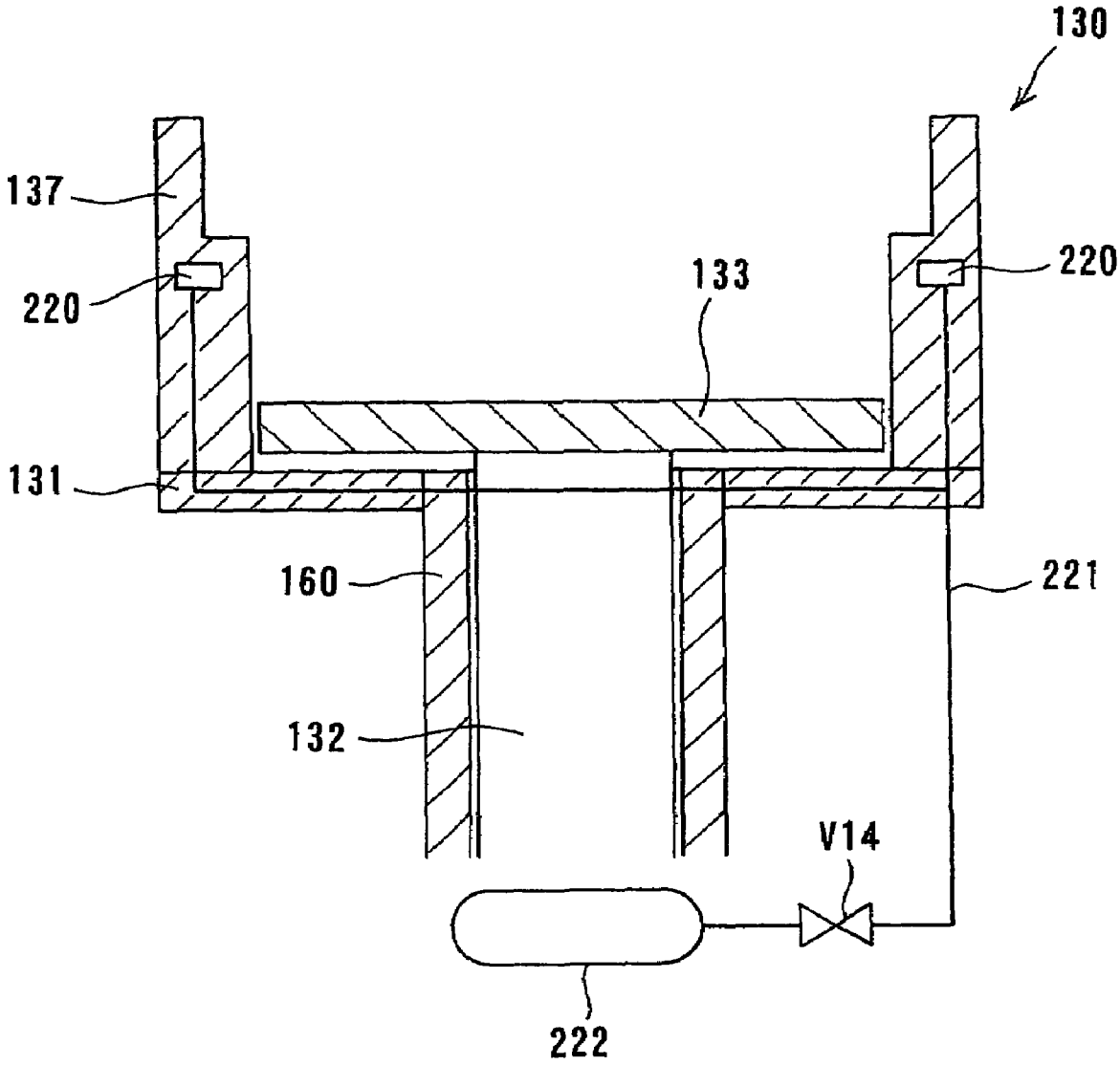
FIG. 12 is a cross-sectional view schematically showing a pusher according to a third embodiment of the present invention.

FIG. 12 shows a pusher 130 according to a third embodiment of the present invention. FIG. 12 is a cross-sectional view schematically showing the pusher 130 and illustrates only main parts of the pusher 130. Thus, the pusher 130 is illustrated as including guide stage 131, top ring guides 137, push stage 133, spline shaft 132 to vertically move the push stage 133, and hollow shaft 160. As shown in FIG. 12, the top ring guides 137 each have at least one nozzle 220, which serve as high-pressure fluid ports for ejecting a high-pressure fluid toward a semiconductor wafer. The nozzles 220 are connected through a pipe 221 to a compressed fluid supply source 222. The nozzles 220 are located at positions at which a semiconductor wafer is removed from the top ring 1. A valve V14 is provided in pipe 221 connected to the compressed fluid supply source 222. The compressed fluid supply source 222 is configured to supply high-pressure pure water or a high-pressure mixture of at least two kinds of a liquid and a gas (e.g., pure water and nitrogen). The pusher 130 has a cover (not shown) for preventing an ejected high-pressure fluid from scattering around the nozzles 220.

Figures 13A, 13B, 13C:
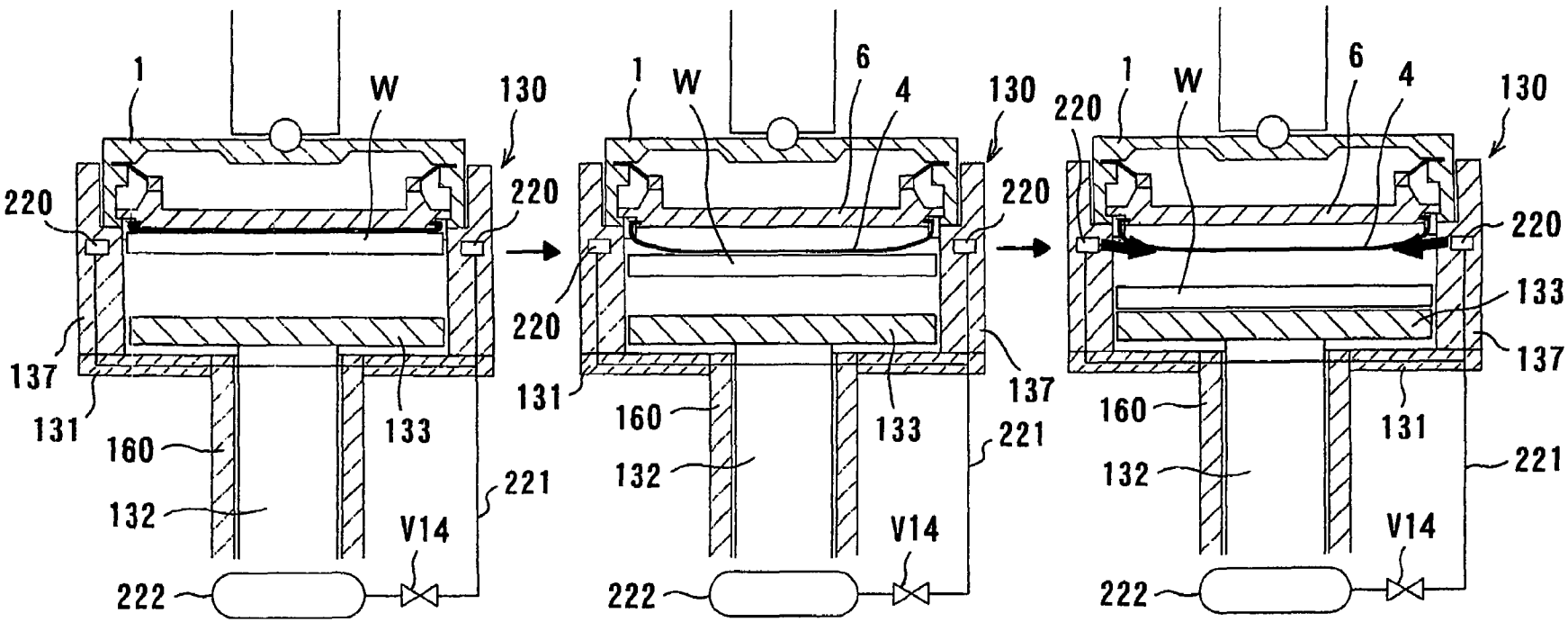
FIGS. 13A through 13C are vertical cross-sectional views explanatory of operation of the pusher shown in FIG. 12.

Operation of this pusher 130 thus constructed will be described. FIGS. 13A through 13C are cross-sectional views explanatory of operation of the pusher 130.

The top ring 1 transfers a semiconductor wafer W to a wafer unloading position located above the pusher 130. Then, air cylinder 136 (see FIG. 5) is actuated to lift the pusher 130 so that the top ring 1 is brought into engagement with the top ring guides 137 as shown in FIG. 13A. Thereafter, as shown in FIG. 13B, a pressurized fluid (e.g., compressed air or a mixture of nitrogen and pure water) is ejected to the semiconductor wafer W through the communication holes 61*a* and 62*a* (see FIG. 2) of the suction portions 61 and 62 of the top ring 1, and another pressurized fluid is supplied to all of or part of the pressure chambers 22-25 to swell membrane (elastic pad) 4. At that time, a pressurized fluid is supplied to the pressure chamber 21 so as to move the subcarrier plate 6 downward. Thus, the semiconductor wafer W is located below the lower end of the retainer ring 3, and the membrane 4 of the top ring 1 is separated and spaced from the semiconductor wafer W at a peripheral portion thereof. In such a state that the peripheral portion of the semiconductor wafer W is spaced from the membrane 4, the valve V14 is opened so as to eject a high-pressure fluid (e.g., pure water or a mixture of gas such as nitrogen and pure water) from the nozzles 220. Thus, the semiconductor wafer W is removed from the membrane 4 by the high-pressure fluid (see FIG. 13C). Thereafter, the pusher 130 is lowered. On the way to lower the pusher 130, the semiconductor wafer W is transferred from the pusher 130 to the transfer stage of the linear transporter 105, which is not shown in these figures.

As described above, according to the present embodiment, when a semiconductor wafer W is transferred from the top ring 1 to the pusher 130, a pressurized fluid is supplied to all of or part of the pressure chambers 22-25 to swell the membrane (elastic pad) 4. Another pressurized fluid is supplied to the pressure chamber 21 so as to move the subcarrier plate 6 downward. Thus, the semiconductor wafer W is located below the lower end of the retainer ring 3, and the membrane 4 of the top ring 1 is separated and spaced from the semiconductor wafer W at a peripheral portion thereof. In such a state, a high-pressure fluid is ejected from the nozzles 220 between the membrane 4 and the semiconductor wafer W. Thus, the semiconductor wafer W can be removed from the membrane 4 by pressure of the high-pressure fluid. When the semiconductor wafer W is removed from the top ring 1, only a slight gap is formed between a lower end surface of the semiconductor wafer W and the push stage 133. Accordingly, it is possible to prevent the semiconductor wafer from falling down toward the pusher 130 with force.

Figure 14:
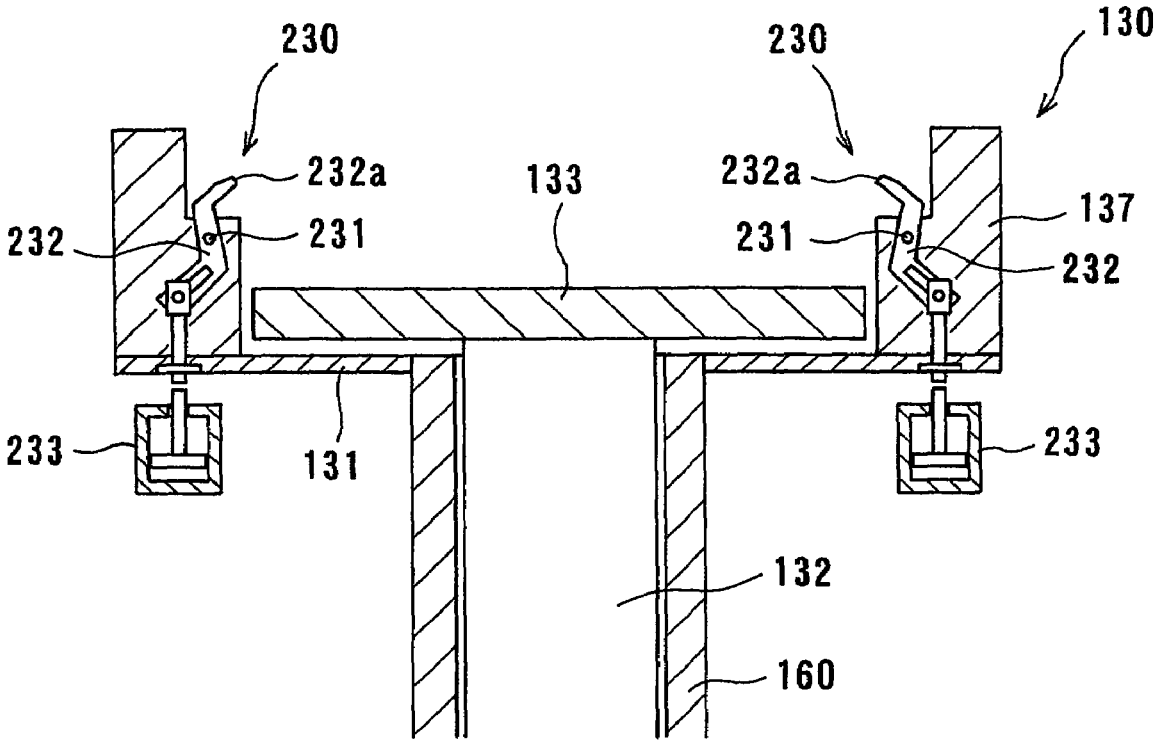
FIG. 14 is a cross-sectional view schematically showing a pusher according to a fourth embodiment of the present invention.

FIG. 14 shows a pusher 130 according to a fourth embodiment of the present invention. FIG. 14 is a cross-sectional view schematically showing the pusher 130 and illustrates only main parts of the pusher 130. Thus, the pusher 130 is illustrated as including guide stage 131, top ring guides 137, push stage 133, spline shaft 132 to vertically move the push stage 133, and hollow shaft 160. As shown in FIG. 14, the top ring guides 137 each have at least one chucking mechanism 230 for separating a semiconductor wafer from the top ring 1. Each chucking mechanism 230 has a pivotable link 232 supported on a corresponding top ring guide 137 by a pin 231, and an air cylinder 233 connected to a lower end of the link 232. The link 232 has a sharpened tip 232*a*, which can readily be introduced between membrane (elastic pad) 4 of the top ring 1 and a semiconductor wafer W.

Figure 15A:
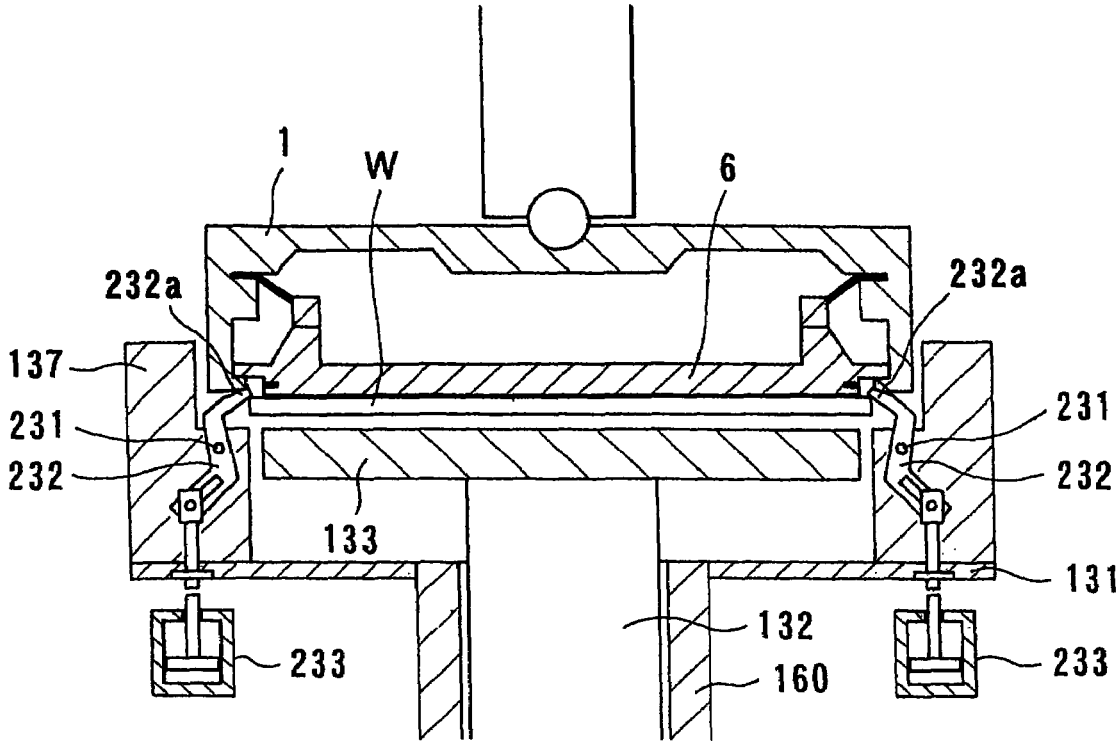
FIGS. 15A and 15B are vertical cross-sectional views explanatory of operation of the pusher shown in FIG. 14.
Figure 15B:
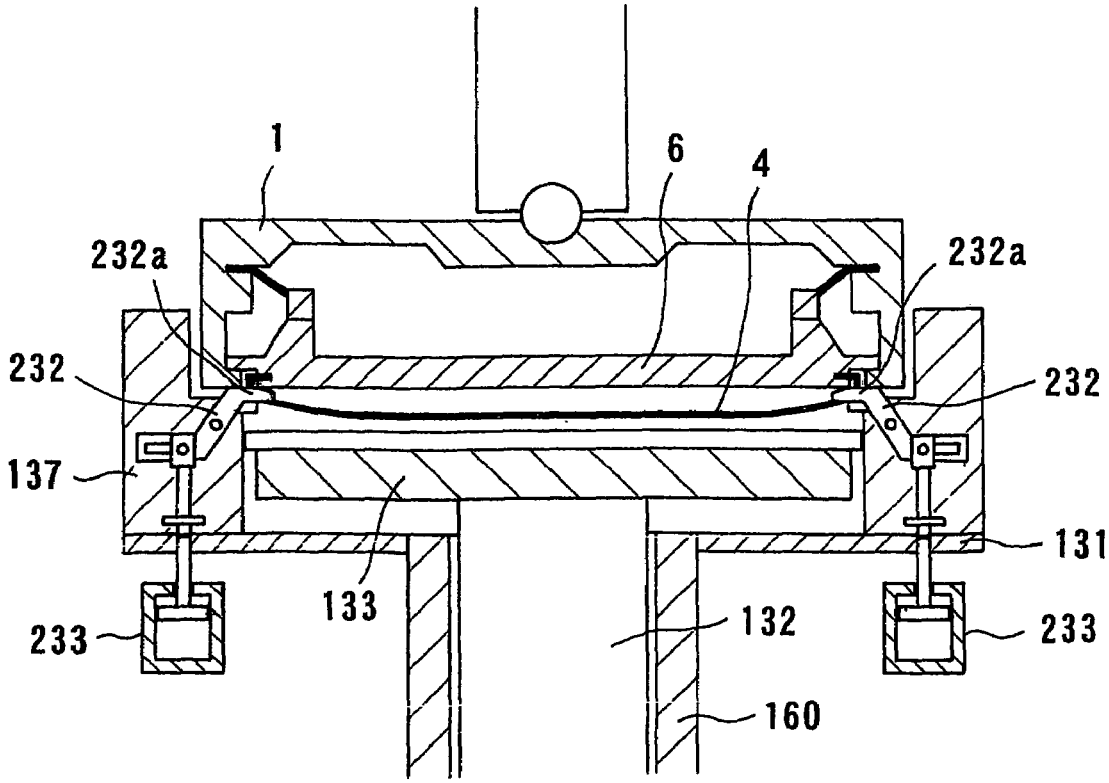

Operation of this pusher 130 thus constructed will be described. FIGS. 15A and 15B are cross-sectional views explanatory of operation of the pusher 130.

The top ring 1 transfers a semiconductor wafer W to a wafer unloading position located above the pusher 130. Then, air cylinder 136 (see FIG. 5) is actuated to lift the pusher 130 so that the lower portion of the top ring 1 is introduced into an interior of the guide stages 137 as shown in FIG. 15A. Thereafter, a pressurized fluid (e.g., compressed air or a mixture of nitrogen and pure water) is ejected to the semiconductor wafer W through the communication holes 61*a* and 62*a* (see FIG. 2) of the suction portions 61 and 62 of the top ring 1, and another pressurized fluid is supplied to all of or part of the pressure chambers 22-25 to swell the membrane (elastic pad) 4. At that time, a pressurized fluid is supplied to the pressure chamber 21 so as to move the subcarrier plate 6 downward. Thus, the semiconductor wafer W is located below the lower end of the retainer ring 3, and the membrane 4 of the top ring 1 is separated and spaced from the semiconductor wafer W at a peripheral portion thereof. In such a state, as shown in FIG. 15B, the air cylinders 233 are actuated to pivot the links 232 to introduce the tips 232*a* of the links 232 between the membrane 4 of the top ring 1 and the semiconductor wafer W. Thus, the semiconductor wafer W is forcibly separated from the membrane 4 by the links 232. Then, the push stage 133 is lowered so as to space the semiconductor wafer W from the top ring 1. Thereafter, the pusher 130 is lowered. On the way to lower the pusher 130, the semiconductor wafer W is transferred from the pusher 130 to the transfer stage of the linear transporter 105, which is not shown in these figures.

As described above, according to the present embodiment, when a semiconductor wafer W is transferred from the top ring 1 to the pusher 130, a pressurized fluid is supplied to all of or part of the pressure chambers 22-25 to swell the membrane (elastic pad) 4. Another pressurized fluid is supplied to the pressure chamber 21 so as to move the subcarrier plate 6 downward. Thus, the semiconductor wafer W is located below the lower end of the retainer ring 3, and the membrane 4 of the top ring 1 is separated and spaced from the semiconductor wafer W at a peripheral portion thereof. In such a state, the air cylinders 233 are actuated to introduce the tips 232*a* of the links 232 between the membrane 4 of the top ring 1 and the semiconductor wafer W. Thus, the semiconductor wafer W is forcibly separated from the membrane 4 by the links 232. When the semiconductor wafer W is removed from the top ring 1, only a slight gap is formed between a lower end surface of the semiconductor wafer W and the push stage 133. Accordingly, it is possible to prevent the semiconductor wafer W from falling down toward the pusher 130 with force.

Figure 16:
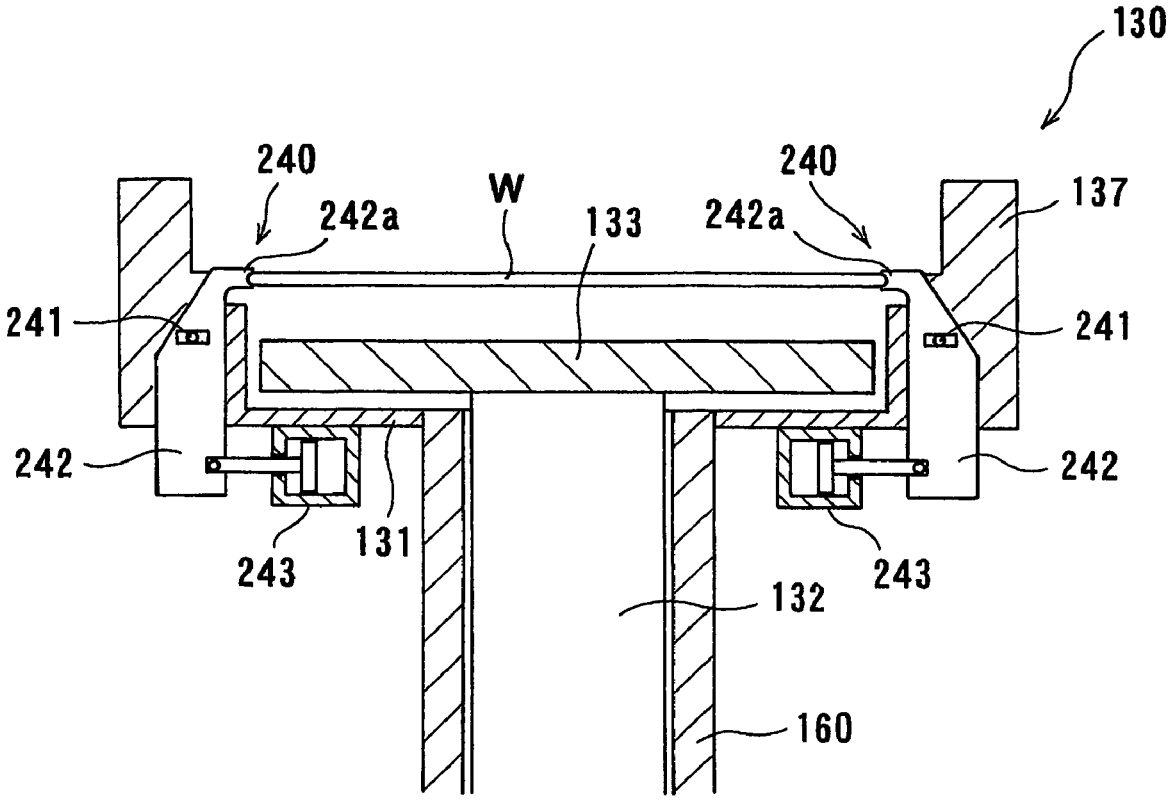
FIG. 16 is a cross-sectional view schematically showing a variation of the pusher shown in FIG. 14.

FIG. 16 is a cross-sectional view showing a variation of the pusher 130 according to the fourth embodiment of the present invention. As shown in FIG. 16, the top ring guides 137 each have at least one chucking mechanism 240 for separating a semiconductor wafer from the top ring 1. Each chucking mechanism 240 has a link 242 supported on a corresponding top ring guide 137, and an air cylinder 243 connected to a lower end of the link 242. The link 242 is movable in a radial direction via a pin 241. The link 242 has a recessed tip 242*a*, which can hold a peripheral edge of a semiconductor wafer W.

Figure 17A:
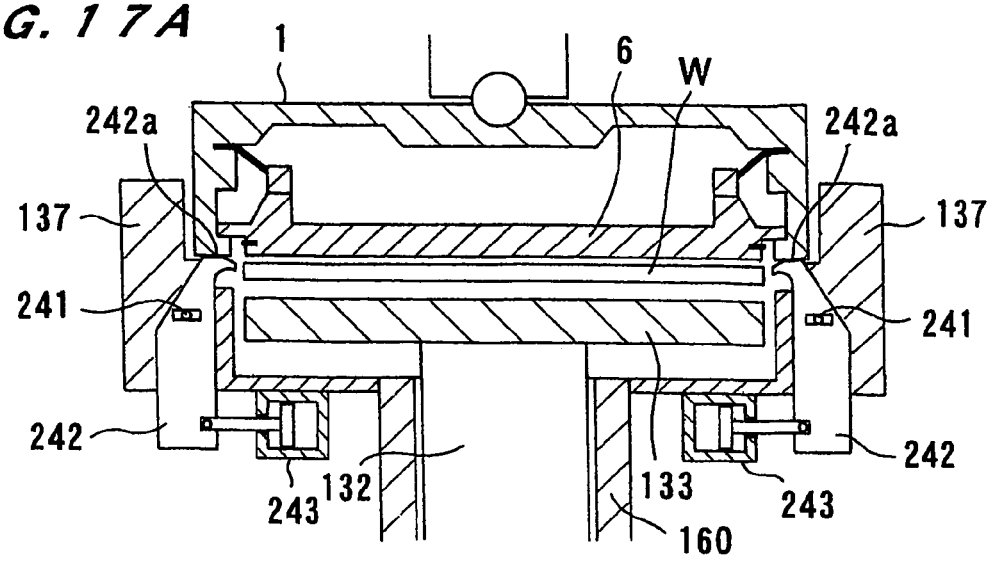
FIGS. 17A through 17C are vertical cross-sectional views explanatory of operation of the pusher shown in FIG. 16.
Figure 17B:
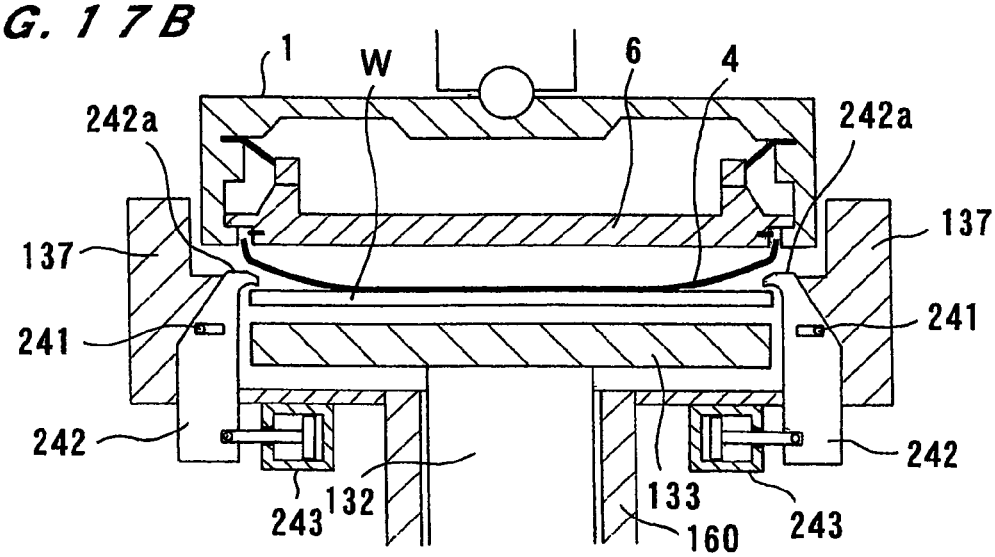
Figure 17C:
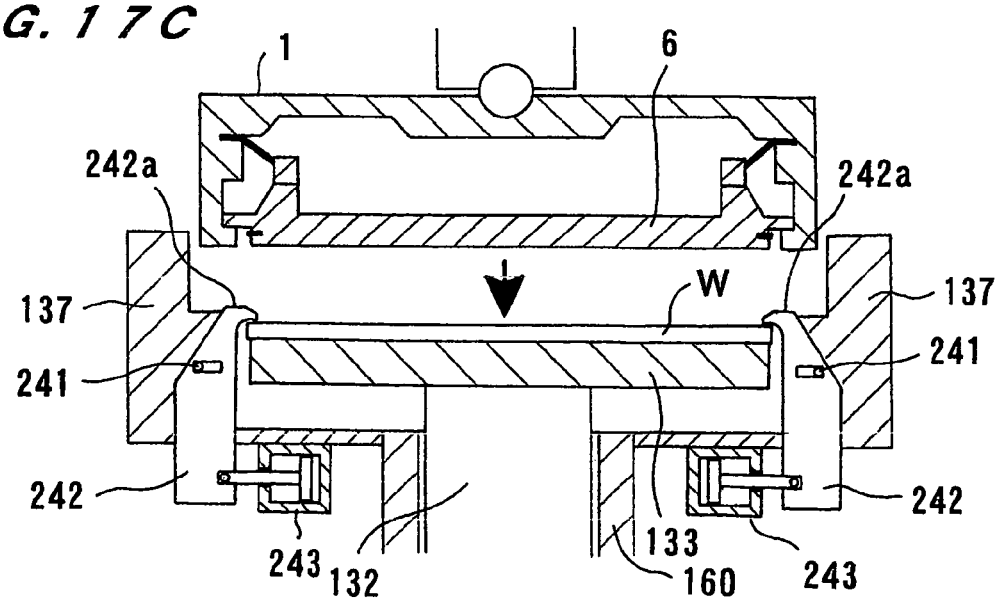

Operation of this pusher 130 thus constructed will be described below. FIGS. 17A through 17C are cross-sectional views explanatory of operation of the pusher 130.

The top ring 1 transfers a semiconductor wafer W to a wafer unloading position located above the pusher 130. Then, air cylinder 136 (see FIG. 5) is actuated to lift the pusher 130 so that the lower portion of the top ring 1 is introduced into an interior of the guide stages 137 as shown in FIG. 17A. Thereafter, a pressurized fluid (e.g., compressed air or a mixture of nitrogen and pure water) is ejected to the semiconductor wafer W through the communication holes 61*a* and 62*a* (see FIG. 2) of the suction portions 61 and 62 of the top ring 1, and another pressurized fluid is supplied to all of or part of the pressure chambers 22-25 to swell membrane (elastic pad) 4. At that time, a pressurized fluid is supplied to the pressure chamber 21 so as to move the subcarrier plate 6 downward. Thus, the semiconductor wafer W is located below the lower end of the retainer ring 3, and the membrane 4 of the top ring 1 is separated and spaced from the semiconductor wafer W at a peripheral portion thereof. In such a state, as shown in FIG. 17B, the air cylinders 243 are actuated to move the links 242 radially inward to hold the peripheral edge of the semiconductor wafer W horizontally by the recessed tips 242*a* of the links 242. Then, the pusher 130 is lowered as shown in FIG. 17C so as to space the semiconductor wafer W from the top ring 1 while the semiconductor wafer W is held by the links 242. On the way to lower the pusher 130, the semiconductor wafer W is transferred from the pusher 130 to the transfer stage of the linear transporter 105, which is not shown in these figures.

As described above, according to the present embodiment, when a semiconductor wafer W is transferred from the top ring 1 to the pusher 130, a pressurized fluid is supplied to all of or part of the pressure chambers 22-25 to swell the membrane (elastic pad) 4. Another pressurized fluid is supplied to the pressure chamber 21 so as to move the subcarrier plate 6 downward. Thus, the semiconductor wafer W is located below the lower end of the retainer ring 3, and the membrane 4 of the top ring 1 is separated and spaced from the semiconductor wafer W at a peripheral portion thereof. In such a state, the air cylinders 243 are actuated to hold the peripheral edge of the semiconductor wafer W by the tips 242*a* of the links 242. Thus, the semiconductor wafer W is forcibly separated from the membrane 4 by the links 242. When the semiconductor wafer W is removed from the top ring 1, only a slight gap is formed between a lower end surface of the semiconductor wafer W and the push stage 133. Accordingly, it is possible to prevent the semiconductor wafer W from falling down toward the pusher 130 with force.

Figure 18:
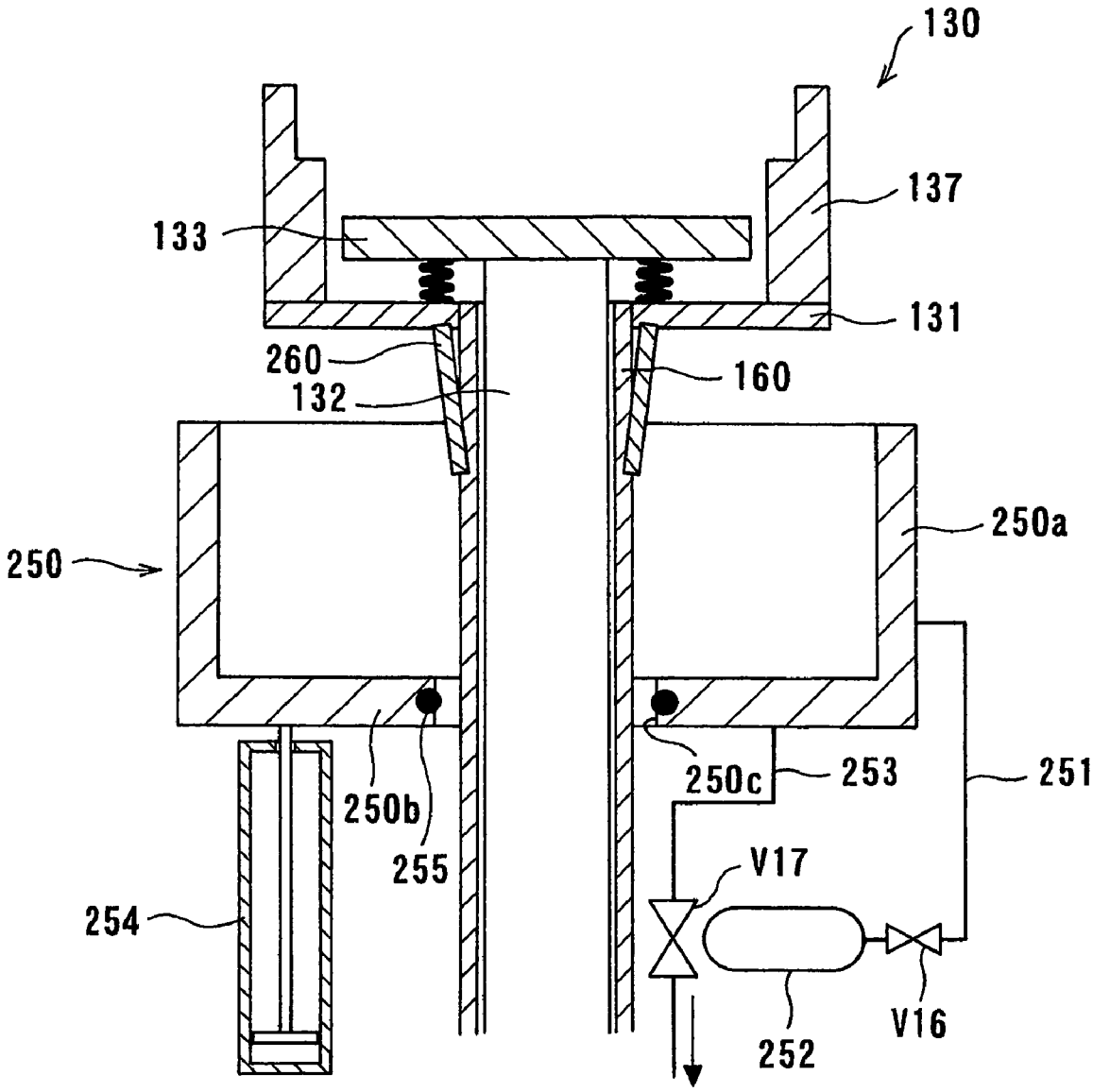
FIG. 18 is a cross-sectional view schematically showing a pusher according to a fifth embodiment of the present invention.

FIG. 18 shows a pusher 130 according to a fifth embodiment of the present invention. FIG. 18 is a cross-sectional view schematically showing the pusher 130 and illustrates only main parts of the pusher 130. Thus, the pusher 130 is illustrated as including guide stage 131, top ring guides 137, push stage 133, spline shaft 132 to vertically move the push stage 133, and hollow shaft 160. As shown in FIG. 18, a tub 250 is provided radially outward of the pusher 130. The tub 250 is in a form of a cylindrical receptacle and is disposed concentrically with the shaft 132 of the pusher 130. The tub 250 has a cylindrical portion 250*a*, which has an inside diameter larger than an outside diameter of the top ring guide 137, and a bottom portion 250*b*, which has an opening 250*c*. The tub 250 is connected through a pipe 251 to a pure water supply source 252. A valve V16 is provided in the pipe 251. A drain pipe 253 is connected to the bottom portion 250*b* of the tub 250. A valve V17 is provided in the drain pipe 253. An air cylinder 254 is connected to the bottom portion 250*b* of the tub 250. Thus, when the air cylinder 254 is actuated, the tub 250 is moved in a vertical direction.

Figure 19B:
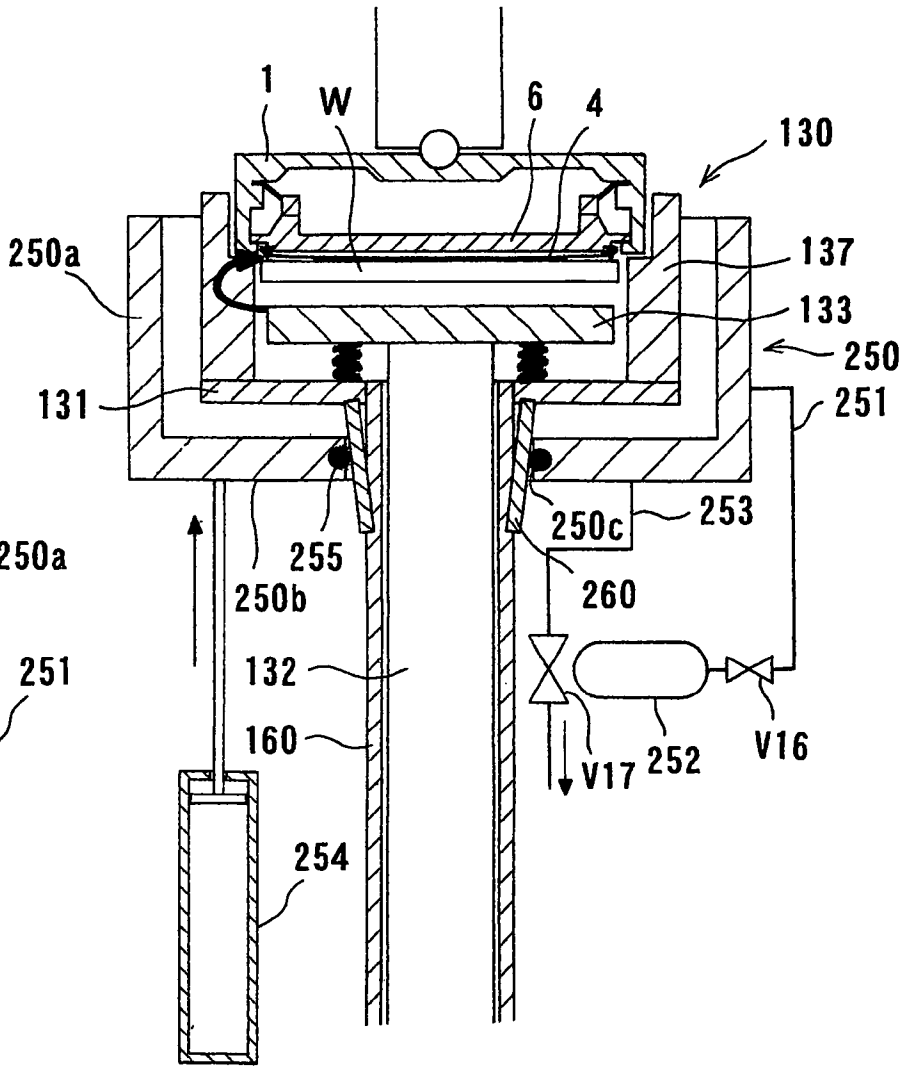
FIGS. 19A and 19B are vertical cross-sectional views explanatory of operation of the pusher shown in FIG. 18.
Figure 19A:
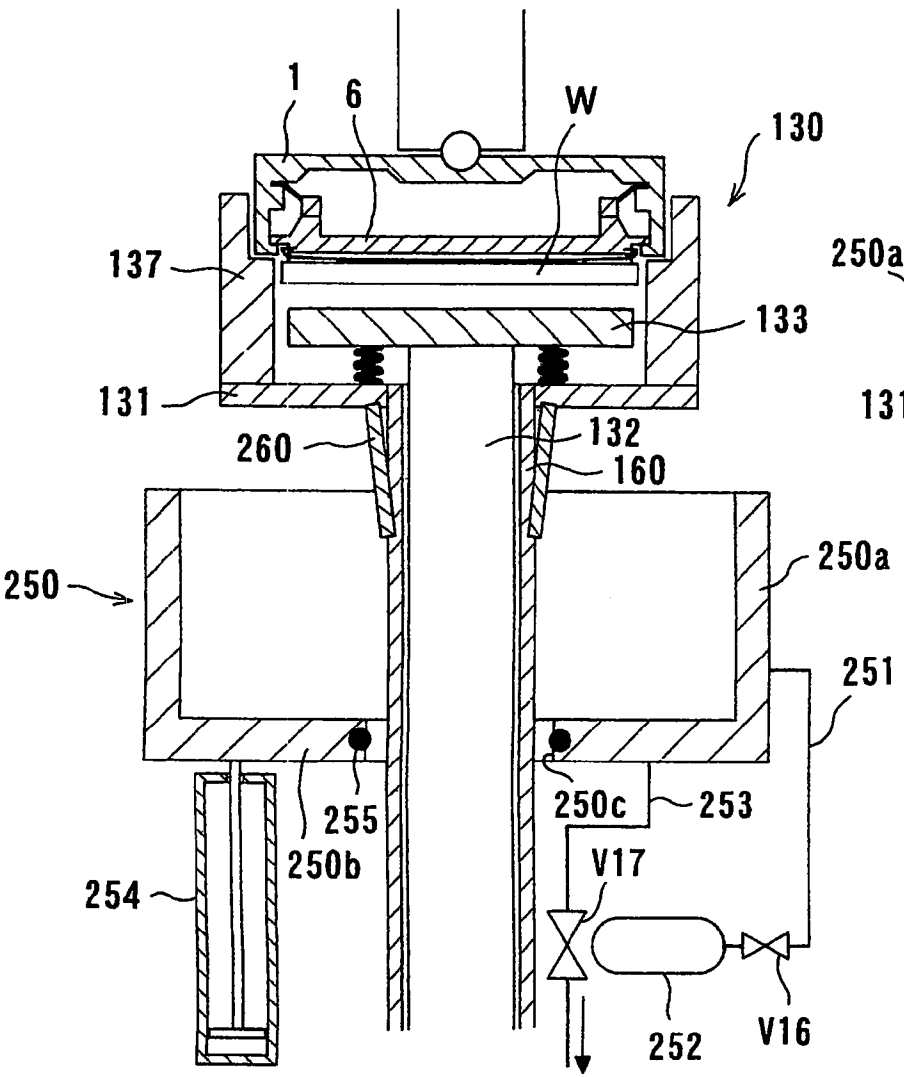

Operation of this pusher 130 thus constructed will be described below. FIGS. 19A and 19B are cross-sectional views explanatory of operation of the pusher 130.

The top ring 1 transfers a semiconductor wafer W to a wafer unloading position located above the pusher 130. Then, air cylinder 136 (see FIG. 5) is actuated to lift the pusher 130 so that the top ring 1 is brought into engagement with the top ring guides 137 as shown in FIG. 19A. Then, the air cylinder 254 is actuated to lift the tub 250 so that the pusher 130 and the lower portion of the top ring 1 are housed in the tub 250. At that time, an O-ring 255 provided in the opening 250*c* of the tub 250 is brought into engagement with a cylindrical member 260, which projects downward from the pusher 130, to seal an interior of the tub 250. In this state, as shown in FIG. 19B, the valve V16 is opened so as to supply pure water from the pure water supply source 252 into the interior of the tub 250. Thus, the pusher 130 in its entirety and the lower portion of the top ring 1 are immersed in the pure water in the tub 250.

At that time, a pressurized fluid (e.g., compressed air or a mixture of nitrogen and pure water) is ejected to the semiconductor wafer W through the communication holes 61*a* and 62*a* (see FIG. 2) of the suction portions 61 and 62 of the top ring 1, and another pressurized fluid is supplied to all of or part of the pressure chambers 22-25 to swell membrane (elastic pad) 4. A pressurized fluid is supplied to the pressure chamber 21 so as to move the subcarrier plate 6 downward. Thus, the semiconductor wafer W is located below the lower end of the retainer ring 3, and the membrane 4 of the top ring 1 is separated and spaced from the semiconductor wafer W at a peripheral portion thereof. Thus, the pure water is introduced between the membrane (elastic pad) 4 of the top ring 1 and the semiconductor wafer W so as to release adherence of the semiconductor wafer W to the top ring 1. Thus, the semiconductor wafer W is separated from the top ring 1. Then, the push stage 133 is lowered so as to space the semiconductor wafer W from the top ring 1. Thereafter, the pusher 130 is lowered. On the way to lower the pusher 130, the semiconductor wafer W is transferred from the pusher 130 to the transfer stage of the linear transporter 105, which is not shown in these figures.

In the present embodiment, when a semiconductor wafer W is transferred from the top ring 1 to the pusher 130, the semiconductor wafer W is immersed in pure water. Accordingly, polishing wastes or slurry (polishing liquid) attached to the semiconductor wafer W can be removed by the pure water. Thus, the semiconductor wafer W can be cleaned simultaneously. Thereafter, the valve V17 of the drain pipe 253 is opened so as to discharge the pure water from the tub 250. After the pure water is discharged, the air cylinder 254 is actuated to lower the tub 250. Thus, operation of transferring the semiconductor wafer W is completed.

As described above, according to the present embodiment, pure water stored in the tub is introduced between the semiconductor wafer W and the substrate holding surface of the top ring 1 to release adherence of the semiconductor wafer W to the top ring 1. Thus, the semiconductor wafer W can be separated from the top ring 1. Further, since water is present between the push stage 133 and the semiconductor wafer W when the semiconductor wafer W is separated from the top ring 1, it is possible to prevent the semiconductor wafer from falling down toward the pusher 130 with force due to ejection of pressurized fluid.

Although certain preferred embodiments of the present invention have been shown and described in detail, it should be understood that various changes and modifications may be made therein without departing from the scope of the appended claims.

INDUSTRIAL APPLICABILITY

The present invention is suitable for use in a polishing apparatus for polishing a substrate such as a semiconductor wafer to a flat mirror finish.

The invention claimed is:

1. A polishing apparatus comprising:

a substrate holding device configured to hold a substrate on a substrate holding surface so as to allow the substrate to be polished by a polishing surface, said substrate holding device including (i) a support member, (ii) an elastic pad having the substrate holding surface, wherein said elastic pad is supported by said support member, and (iii) a retainer ring surrounding the substrate when the substrate is held by said elastic pad; and a substrate relay device configured to deliver the substrate to said substrate holding device and receive the substrate from said substrate holding device, said substrate relay device including (i) a substrate placement section having a substrate placement surface on which the substrate is to be placed, (ii) a moving mechanism configured to vertically move said substrate placement section, and (iii) a fluid port configured to eject a pressurized fluid to a peripheral portion of the substrate, to remove the substrate from said elastic pad, when the substrate is positioned below a lower surface of said retainer ring and is held by said substrate holding device such that the substrate is in contact with said substrate holding surface except for the peripheral portion of the substrate.

2. The polishing apparatus according to claim 1, wherein said elastic pad is capable of being swelled and said support member is movable relative to said retainer ring, such that the substrate is to be positioned below the lower surface of said retainer ring and is to be in contact with said substrate holding surface, except for the peripheral portion of the substrate, by virtue of said elastic pad being swollen and said support member having been moved downward relative to said retainer ring.

3. The polishing apparatus according to claim 2, wherein said substrate holding device further includes (v) an abutment member attached to said support member, said abutment member having an elastic membrane to be brought into contact with said elastic pad, (vi) a first pressure chamber defined between said body and said support member, (vii) a second pressure chamber defined outside of said abutment member between said elastic pad and said support member, and (viii) a third pressure chamber defined inside of said abutment member, such that said elastic pad is capable of being swelled by supplying pressurized fluid to said second pressure chamber and said third pressure chamber, and said support member is movable relative to said retainer ring by supplying pressurized fluid to said first pressure chamber.

4. The polishing apparatus according to claim 3, wherein said first pressure chamber, said second pressure chamber, and said third pressure chamber are independently connectable to a fluid supply source and a vacuum source.

5. The polishing apparatus according to claim 4, wherein said substrate relay device further includes a cover provided around said fluid port to prevent the pressurized fluid from scattering around said fluid port.

6. The polishing apparatus according to claim 4, wherein said elastic pad has an opening connectable to at least one of the fluid supply source and the vacuum source.

7. The polishing apparatus according to claim 4, wherein said substrate holding device has a passage configured to supply a pressurized fluid from said substrate holding surface to the substrate when the substrate is held by said substrate holding device.

8. The polishing apparatus according to claim 3, wherein said substrate relay device further includes a cover provided around said fluid port to prevent the pressurized fluid from scattering around said fluid port.

9. The polishing apparatus according to claim 3, wherein said elastic pad has an opening connectable to at least one of a fluid supply source and a vacuum source.

10. The polishing apparatus according to claim 3, wherein said substrate holding device has a passage configured to supply a pressurized fluid from said substrate holding surface to the substrate when the substrate is held by said substrate holding device.

11. The polishing apparatus according to claim 2, wherein said substrate relay device further includes a cover provided around said fluid port to prevent the pressurized fluid from scattering around said fluid port.

12. The polishing apparatus according to claim 2, wherein said elastic pad has an opening connectable to at least one of a fluid supply source and a vacuum source.

13. The polishing apparatus according to claim 12, wherein said substrate holding device further includes (v) an abutment member attached to said support member, said abutment member having an elastic membrane to be brought into contact with said elastic pad, (vi) a first pressure chamber defined between said body and said support member, (vii) a second pressure chamber defined outside of said abutment member between said elastic pad and said support member, and (viii) a third pressure chamber defined inside of said abutment member, with said first pressure chamber, said second pressure chamber, and said third pressure chamber being independently connectable to the at least one of a fluid supply source and a vacuum source.

14. The polishing apparatus according to claim 2, wherein said substrate holding device has a passage configured to supply a pressurized fluid from said substrate holding surface to the substrate when the substrate is held by said substrate holding device.

15. The polishing apparatus according to claim 1, wherein said substrate relay device further includes a cover provided around said fluid port to prevent the pressurized fluid from scattering around said fluid port.

16. The polishing apparatus according to claim 15, wherein said elastic pad has an opening connectable to at least one of a fluid supply source and a vacuum source.

17. The polishing apparatus according to claim 16, wherein said substrate holding device further includes (v) an abutment member attached to said support member, said abutment member having an elastic membrane to be brought into contact with said elastic pad, (vi) a first pressure chamber defined between said body and said support member, (vii) a second pressure chamber defined outside of said abutment member between said elastic pad and said support member, and (viii) a third pressure chamber defined inside of said abutment member, with said first pressure chamber, said second pressure chamber, and said third pressure chamber being independently connectable to the at least one of a fluid supply source and a vacuum source.

18. The polishing apparatus according to claim 15, wherein said substrate holding device has a passage configured to supply a pressurized fluid from said substrate holding surface to the substrate when the substrate is held by said substrate holding device.

19. The polishing apparatus according to claim 1, wherein said elastic pad has an opening connectable to at least one of a fluid supply source and a vacuum source.

20. The polishing apparatus according to claim 19, wherein said substrate holding device further includes (v) an abutment member attached to said support member, said abutment member having an elastic membrane to be brought into contact with said elastic pad, (vi) a first pressure chamber defined between said body and said support member, (vii) a second pressure chamber defined outside of said abutment member between said elastic pad and said support member, and (viii) a third pressure chamber defined inside of said abutment member, with said first pressure chamber, said second pressure chamber, and said third pressure chamber being independently connectable to the at least one of a fluid supply source and a vacuum source.

21. The polishing apparatus according to claim 1, wherein said substrate holding device has a passage configured to supply a pressurized fluid from said substrate holding surface to the substrate when the substrate is held by said substrate holding device.

* * * * *